US006045018A

United States Patent [19]

Onishi

[11] Patent Number: 6,045,018

[45] Date of Patent: Apr. 4, 2000

[54] BABY CARRIER

[75] Inventor: Ichiro Onishi, Nara, Japan

[73] Assignee: Aprica Kassai Kabushikikaisha, Osaka, Japan

[21] Appl. No.: 09/024,066

[22] Filed: Feb. 17, 1998

[30] Foreign Application Priority Data

| | | | |
|---|---|---|---|
| Feb. 17, 1997 | [JP] | Japan | 9-049650 |
| Feb. 18, 1997 | [JP] | Japan | 9-051077 |
| Feb. 28, 1997 | [JP] | Japan | 9-062473 |
| Apr. 10, 1997 | [JP] | Japan | 9-110218 |

[51] Int. Cl.[7] ..... A61G 1/00

[52] U.S. Cl. ..... 224/158; 224/159; 224/160

[58] Field of Search ..... 224/158–161, 224/153

[56] References Cited

U.S. PATENT DOCUMENTS

| | | | |
|---|---|---|---|
| 5,071,047 | 12/1991 | Cordisco | 224/158 |
| 5,205,451 | 4/1993 | Manzer | 224/161 |
| 5,246,152 | 9/1993 | Dotseth | 224/159 |
| 5,690,258 | 11/1997 | Kataoka | 224/160 |

FOREIGN PATENT DOCUMENTS 8150051 6/1996 Japan .

*Primary Examiner*—Stephen P. Garbe
*Assistant Examiner*—Maerena W. Brevard
*Attorney, Agent, or Firm*—W. F. Fasse; W. G. Fasse

[57] ABSTRACT

A baby carrier includes a carrier body having a front cover portion, a crotch cover portion and a back cover portion which are integrally formed in continuation of one another. A pair of shoulder belts extend from opposite ends of the back cover portion and include first buckles at the tips of first belt members. Second buckles detachably engaging with the first buckles are connected opposite ends of the front cover portion via second belt members. Hook members are provided at the opposite ends of the front cover portion. At least a pair of ring members detachably engaging with the hook members are provided at the back cover portion. A headrest for supporting the back of the baby's head is provided at the back cover portion. A head support includes a head support body of which the bottom portion is attached to the headrest, and band-like portions laterally extending from both sides of the head support body, whereby tips of the band-like portions are attached to the back cover portion or the shoulder belts. The head support body stands up from the headrest and protects the top of the baby's head when the baby is supported in a horizontal position. The head support body is positioned integrally with the headrest and supports the back of the baby's head when the baby is supported in a vertical position.

16 Claims, 30 Drawing Sheets

BABY CARRIER

CROSS-REFERENCE TO RELATED APPLICATION

This application is related to copending U.S. application Ser. No. 09/239,465, entitled "BABY CARRIER".

BACKGROUND OF THE INVENTION

The present invention relates to a baby carrier for carrying a baby while holding the baby therein.

This applicant has proposed a baby carrier in which a baby can be carried in an upright or "up-down" (vertical) position, as disclosed in Japanese Patent Application Laid-Open No. 8-150051. As shown in present FIGS. 23 and 24, the know baby carrier has a carrier body 72 in which a front portion 73, a crotch portion 74 and a back portion 75 are integrally formed.

Downwardly extending shoulder belts 76, 76' are provided at the front portion 73. Buckles 77, 77' are attached to the tips of the shoulder belts 76, 76'. On the top portion of the shoulder belts 76, 76' there are provided D-shaped ring members 80, 80' and belt members 91, 91'. Cover-equipped buckles 90, 90' are attached to the tips of the belt members 91, 91'.

Buckles 78, 78', which can be engaged with the buckles 77, 77', are connected to the sides of the front portion 74 via belt members 79, 79'. Hook members 81, 81', which can be engaged with the ring members 80, 80', are provided on the top of the back portion 75. In the back portion 75, buckles 92, 92', which can be engaged with the buckles 90, 90', are located via belt members 79, 79'.

In order to assemble the baby carrier 70, first, the shoulder belts 76, 76' are placed on both shoulders of the person who will carry the baby, called "the baby nursing person" herein, and the buckles 77, 77' at the bottom ends of the shoulder belts 76, 76' are engaged with the buckles 78, 78' on the sides of the belt members 79, 79'.

Next, the person holds the baby and lifts up the back portion 75 of the baby carrier 70 with one arm, and the baby is cradled into the back portion 75. Then, as shown in FIG. 25, the hook members 81, 81' are engaged with the ring members 80, 80'. The buckles 90, 90' are engaged with the buckles 92, 92'. Thereby, the baby carrier 70 is assembled and the baby is supported in the baby carrier 70.

As mentioned above, in the assembly of the conventional baby carrier, the nursing person must engage the hook members and ring members as well as the cover-equipped buckles and other buckles, and the assembly work is tedious. In addition, since the assembly of the baby carrier must be performed with a baby supported therein the work load of the baby nursing person is rather heavy.

On the other hand, "a side-supporting-type of baby carrier" is also generally used. In this baby carrier a baby of an early age is supported in a horizontal lying position. A typical side-supporting baby carrier is classified into a net type , shown in FIGS. 26, 27, and an integral carrier type, shown in FIGS. 28, 29.

As show in FIG. 26, the net type baby carrier is comprised of an expandable net portion 101 for supporting the body of a baby, a head rest portion 102 for supporting the head of the baby, shoulder belts 103 for a nursing person, and a support belt 104 for sustaining the head rest portion 102 from its back.

To utilize this baby carrier, first, the net portion 101 is placed on the front side of the nursing person and the belt 103 is placed at an angle onto the shoulder of the person. Next, as shown in FIG. 27, the baby is placed inside the net portion 101 and the net portion 101 is spread out to wrap the entire body of the baby.

In this case, the entire body of the baby is covered with the net portion 101 such that the baby can be firmly supported in the baby carrier 100, but the baby is supported with its back bent or curved because the net portion 101 is composed of expandable members. Therefore, it is not preferable for the baby's healthy skeletal growth.

As shown in FIG. 28, the integral carrier type baby carrier is comprised of a carrier body 151 where a headrest portion 152 and a back portion 153 are integrally formed, and shoulder belts 154, 155, which will be placed on a baby nursing person's shoulders.

To utilize this baby carrier 150, the buckles of the shoulder belts 154, 155 are first connected and then the shoulder belts 154, 155 are placed at an angle onto the nursing person's shoulder. Next, as shown in FIG. 29, the baby is placed on the carrier body 151.

In this case, since the back of the baby is supported by the flat carrier body 151, the baby can be supported in the carrier 150 with its back stretched. But, the baby is simply placed in the carrier body 151. The baby may fall off and down from the carrier body 151 when the nursing person bends down. In addition, the headrest portion 152, integrally formed with the back portion 153, is only an extension of the back portion 103 and the head of the baby is simply placed on the headrest portion 152. Therefore, the head of the baby of an early age cannot be supported in a stable manner.

Furthermore, the baby carrier shown in FIGS. 30–33 is conventionally used as a side-supporting and an up/down-supporting baby carrier. These figures show the same baby carrier and it can be used either as a side-supporting baby carrier with the baby lying horizontally as shown in FIGS. 30, 32, or an up/down-supporting baby carrier with the baby supported in a vertical upright position as shown in FIGS. 31, 33, by switching the belt connection placement.

This baby carrier 200 has a carrier body 201 where a headrest portion 202 and a back portion 203 for supporting the baby's head and back, respectively, are integrally formed . Belts A-G are attached to the carrier body 201.

When the baby carrier 200 is used for side supporting of the baby, as shown in FIG. 30, the tip of the belt C is engaged with the belt A via a fastener and the buckle at the tip of the belt G is connected to the buckle at the tip of the belt F. Next, the buckle at the tip of the belt A is connected to the buckle at the tip of the belt D to compose the shoulder belt 204.

In this condition, the baby is placed on the carrier body 201 and the shoulder belt 204 is placed at an angle onto one shoulder of the nursing person (see FIG. 32). Next, the belt E is wound around the hip of the nursing person and the buckle at the tip of the belt E is connected to the buckle at the tip of the belt B to compose the waist belt 205 for holding the carrier body 201 on the hip of the nursing person.

On the other hand, when the baby carrier 200 is used for up/down supporting of the baby, as shown in FIG. 31, the tip of the belt G is engaged with the belt A via a fastener and the buckle at the tip of the belt A is connected to the buckle at the tip of the belt D to compose the shoulder belt 204'.

Next, with the baby placed on the carrier body 201, the buckles of the belts B and C are connected together for holding the baby on the carrier body 201. In this condition, the shoulder belt 204' is placed at an angle onto one shoulder of the nursing person (see FIG. 33). Then, the belt E is wound around the nursing person' hip and the buckle at the tip of the belt E is connected to the buckle at the tip of the belt F to compose the waist belt 205' for holding the carrier body 201 on the hip of the nursing person.

As mentioned above, the conventional baby carrier is used either for side supporting or up/down supporting by changing the fastening conditions of the multiple belts, but the belt switching operation between side supporting and up/down supporting is very complex. Furthermore, when the baby is supported sideways, as shown in FIGS. 32, the baby is simply placed on the carrier body 201. Therefore, the baby may fall down when the nursing person bends down.

OBJECTS OF THE INVENTION

The main object of the present invention is to provide a the baby carrier which can be assembled in a simple manner.

The second object of the present invention is to prevent a baby from falling off or down when the baby is supported sideways in the integral carrier type baby carrier.

The third object of the present invention is to hold the baby's head stably and firmly in the baby carrier.

The fourth object of the present invention is to provide a the baby carrier with a simple switching operation between side supporting and up/down supporting.

Further objects and advantages of the present invention will be understood from the detailed description that follows.

SUMMARY OF THE INVENTION

The present invention pertains to a baby carrier for carrying a baby while holding the baby therein. According to the first embodiment of the invention, there is provided a baby carrier including a carrier body having a front cover portion, a crotch cover portion, and a back cover portion which are integrally formed in continuation of one another.

At the right and left hand ends of the back portion, a pair of upward extending shoulder belts are provided and at the tip of each shoulder belt, a buckle is provided via a belt member. At the right and left ends of the front portion, buckles that can be detachably engaged with the buckles of the shoulder belt are provided via belt members. Also, at the right and left sides of the front portion, hook members are provided and in the back portion, at least one pair of ring members that can be detachably engaged with the hook members are provided.

When assembling the baby carrier of the first embodiment of the invention, first, the carrier body is spread out and a baby is placed on it. In this condition, the front portion is folded toward the baby's torso and the hook members on both sides of the front portion are engaged with the ring members on the back portion. Thereby, the crotch portion is composed in a bag form so that the baby is held inside the crotch portion.

Next, the buckles of the shoulder belts are engaged with the buckles on the sides of the front portion and the shoulder belts are placed on the shoulders of the baby nursing person. Thereby, the baby carrier is assembled and the baby is supported in the baby carrier.

According to the first embodiment of the invention, in assembly, the nursing person has only to engage the hook members of the front portion with the ring members of the back portion. The assembly of the baby carrier is very simple. Additionally, the baby carrier can be assembled with the baby placed on the spread-out carrier body. Therefore, the work load of the nursing person is not heavy. Moreover, since the shoulder belts are placed not on the side of the front portion but on the top of the back portion, the shoulder belts will not be in the way when engaging the hook members on the front portion with the ring members on the back portion, thus making assembly much easier.

The baby carrier of the second embodiment of the invention has a carrier body in which a front portion, a crotch portion and a back portion are integrally formed, shoulder belts are connected to the carrier body and a headrest is connected to the back portion for supporting the baby's head. On the headrest, a head support is provided. The head support is comprised of a head support body overlapping onto the headrest, of which only the bottom part is attached to the headrest, and a band-like portion extending on both sides of the head support body, of which the tip part is detachably attached to the back portion or the shoulder belt. The head support body is made to stand up from the headrest and it protects the top of the baby's head when the baby is supported sideways.

According to second embodiment of the invention, when the baby is supported in the baby carrier, the back of the baby's head is supported by the headrest and the baby's back is supported by the flat carrier body. Thereby, the baby can be held in the baby carrier with its back stretched.

Also, when the baby is held in the baby carrier, the baby's crotch is supported by the crotch portion of the carrier body, thus preventing the baby from falling off or down from the front portion of the carrier body. In addition, the head support body stands up from the headrest and protects the top of the baby's head. Therefore, the baby is prevented from falling off from the headrest and the head is supported in a stable manner.

The baby carrier of the third embodiment of the invention includes a carrier body composed of an integral front portion, crotch portion and back portion for supporting the baby's front, crotch and back, respectively. A pair of shoulder belts extending upward are provided to both sides of the back portion and buckles are placed at the tips of the shoulder belts via belt members. Buckles that can be detachably engaged with buckles of the shoulders belts, are provided at the opposite ends of the front portion via belt members. In the back portion, a pair of ring members, with which the hook members can detachably engage, are provided in multiple pairs. Hook members are provided at the opposite sides of the front portion.

A headrest for supporting the back of the baby's head is connected to the back portion and a head support is provided on the headrest. The head support comprises a head support body overlapping onto the headrest, of which only the bottom part is attached to the headrest, and band-like portions extending on both sides of the head support body, the tips of which are detachably attached to the back portion or the shoulder belt.

The head support body stands up from the headrest and protects the top of the baby's head when the baby is held sideways. The head support body is integrally positioned with the headrest when the baby is held in the up/down direction, for supporting the back of the baby's head.

Furthermore, a respective core member is inserted in the headrest and in the head support body, respectively, and preferably the core members are partially overlapped.

For holding a baby in the baby carrier of the third embodiment of the invention, first, the baby is placed on the carrier body. In this condition, the front portion is folded toward the baby's torso, the hook members on both sides of the front portion are engaged with the corresponding ring members on the back portion. Thereby, the crotch portion is formed in bag form for holding the baby's crotch.

In assembly, when using the baby carrier as a side holding type, the hook members of the front portion are engaged with the lower ring members in the back portion. As a result, the center of gravity of the baby is placed on the lower part of the carrier body and the baby can be supported in a stable manner.

On the contrary, when using the baby carrier as an up/down holding type, the hook members of the front portion are engaged with the upper ring members in the back portion. Thereby, the crotch opening portion of the baby carrier is made larger so that the baby can be held without harming the baby's crotch when it is held in the up/down direction.

Next, the buckles of the shoulder belts are engaged with the buckles of the front portion. The tip parts of the band-form portions of the head support are attached to the back portion or shoulder belts. Thereby, the baby carrier is assembled.

In this condition, when the baby carrier is used as a side supporting type, the shoulder belts are bundled and placed on one shoulder of the baby nursing person. At this time, the baby's crotch is held by the bag-like crotch part as mentioned above so that the baby can be prevented from falling from the lower portion of the baby carrier.

Furthermore, when the shoulder belts are put on the nursing person's shoulder, the head support body stands up from the headrest, turning around its bottom part to support the baby's head so that the baby can be prevented from falling off from the upper portion of the carrier body. On the other hand, when the baby carrier is used as an up/down supporting type, the shoulder belts are cross-hung on the nursing person's shoulders. At this time, the head support is positioned overlapping with the headrest and the back of the baby's head is supported by the head support body and the headrest.

Next, when the assembled baby carrier is switched from side holding type to up/down holding type, the hook members of the front portion are removed from the ring members of the back portion and instead the hook members are engaged with the ring members in the upper part of the back portion. On the contrary, when the assembled baby carrier is switched from up/down holding type to side holding type, the hook members of the front portion are removed from the ring members of the back portion and instead the hook members are engaged with the lower ring members of the back portion.

In this manner, according to the third embodiment of the invention, switching the baby carrier between side holding type and up/down holding type can be performed by only detachment and engagement of the hook members and ring members.

The baby carrier of the fourth embodiment of the invention has a carrier body including the integral front portion, crotch portion and back portion, for supporting the baby's abdomen, crotch and back, respectively. The baby carrier also includes shoulder belts, and a head support for supporting the baby's head, connected to the back portion. Cores composed of first and second core members are inserted into the head support and a belt piece for guiding the hand of the nursing person is provided on the front side of the head support. Furthermore, parts of the first and second core members are preferably in a partial mutual overlapping position.

According to the fourth embodiment of the invention, when the baby is held in the baby carrier the baby's head is supported by a head support. The first and second core members inside the head support change their angles optionally according to the size or tilting of the baby's head.

For example, when the baby's head is relatively small the angle of the first and second core members becomes greater and the supporting face of the head support bends to fit the baby's head. When the baby's head is relatively large the angle of the first and second core members becomes smaller and the supporting face of the head support becomes a nearly flat configuration. In this manner, the head support can fit the baby's head to provide a stable and firm support of the baby's head.

Furthermore, in this case, a belt piece for guiding the hand of the baby nursing person is provided on the front side of the head support. By inserting the hand of the nursing person between this belt piece and the head support, the baby's head can be supported more stably.

DETAILED DESCRIPTION OF THE PREFERRED EMBODIMENTS

Figure 1:
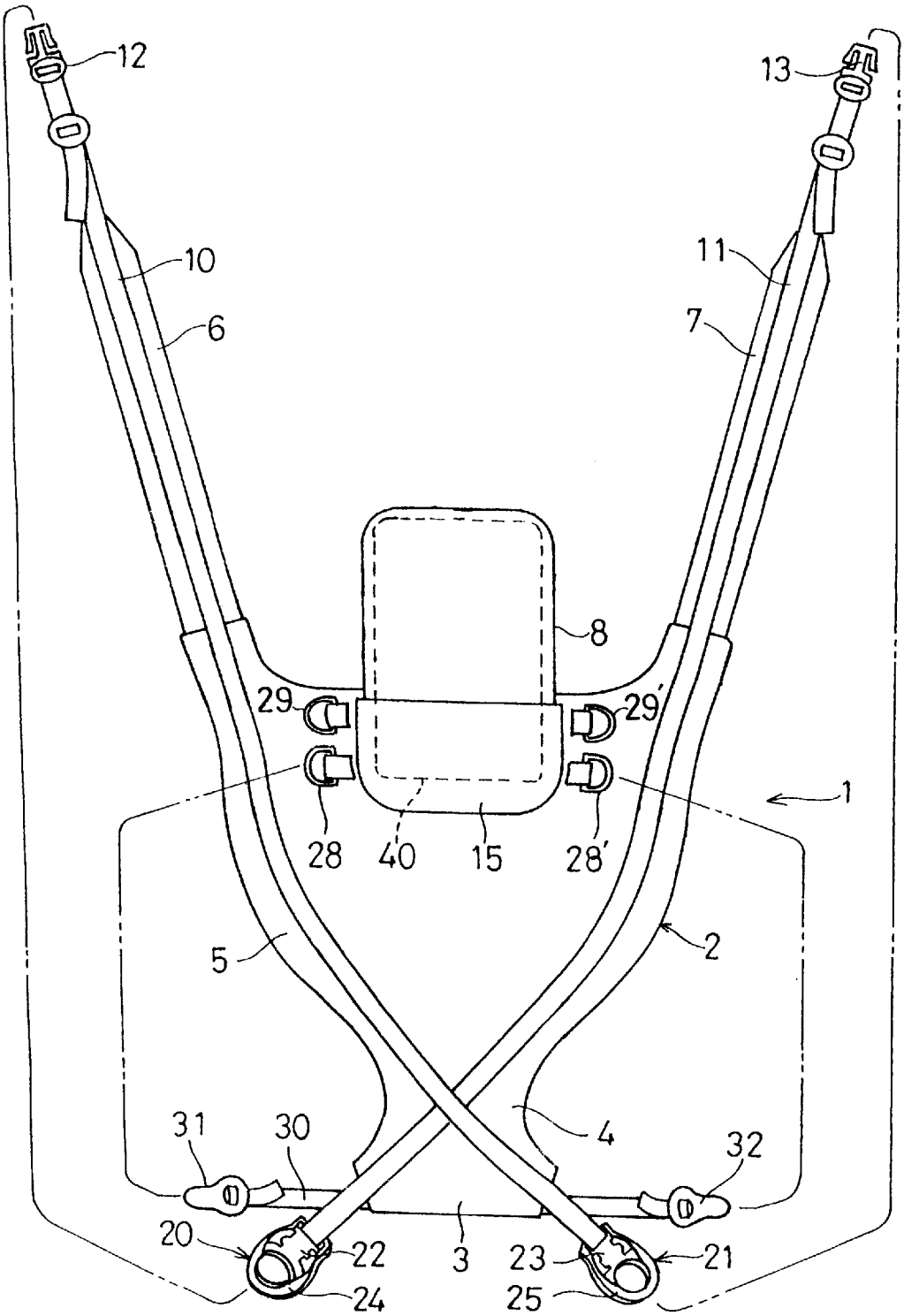
FIG. 1 is a front surface view of a baby carrier, in a developed state, according to one embodiment of the present invention.
Figure 2:
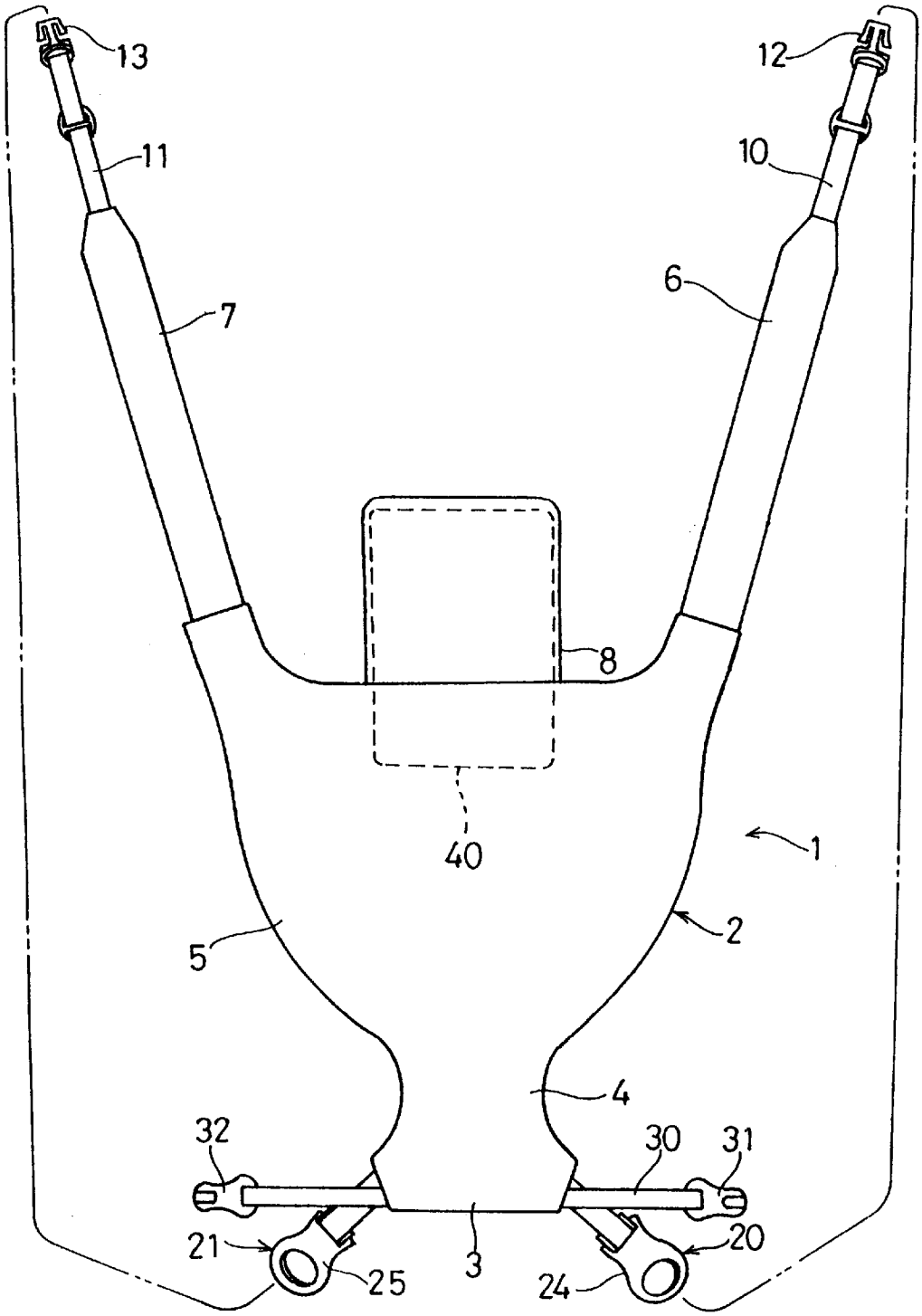
FIG. 2 is a back surface view of the baby carrier in a developed state.

FIGS. 1–6 illustrate a baby carrier of the first embodiment of the present invention. As shown in FIGS. 1 and 2, a baby carrier 1 includes a carrier body 2 having a front cover portion 3, a narrow crotch cover portion 4, and a back cover portion 5 for respectively supporting abdominal, crotch and back portions of a baby, the cover portions being integrally formed in continuation of one another.

The bottom ends of the upward extending shoulder belts 6, 7 are connected to the upper opposite ends of the back portion 5. Upward extending belt members 10, 11 are sewn onto the shoulder belts 6, 7. The belt members 10, 11 run over the upper ends of the shoulder belts 6, 7 and extend upward further and one-touch buckles 12, 13 are attached to their tips.

The belt members 10, 11 extend downward along the opposite ends of the back portion 5 and intersect with one another at the central part of the crotch portion 4 and extend downward further below the front portion 3. The belt members 10, 11 in the carrier body 2 are sewn onto the carrier body 2.

Cover-equipped buckles 20, 21 are attached to the bottom ends of the belt members 10, 11. The buckles 20, 21 are composed of one-touch buckles 22, 23, which can detachably engage with the one-touch buckles 12, 13, respectively, and covers 24, 25 which cover the operating parts of the one-touch buckles 22, 23.

A headrest 8 for supporting the rear portion or back of the baby's head is connected to the top part of the back portion 5. The lower part of the headrest 8 is attached to the inside of a pocket 15 on the back portion 5 via adhesion cloth (or surface fastener) replace and the like. A core 40 is inserted into the headrest 8.

Laterally extending belt members 30 are connected to the lower part of the front portion 3. Hook members 31, 32 are attached to the ends of the belt members 30. Pairs of D-shaped ring members 28, 28' and 29, 29' are attached on the back portion 5 and on both sides of the pocket 15. Hook members 31, 32 can detachably engage with these ring members.

To assemble the aforementioned baby carrier 1, first, a baby is placed on the carrier body 2. In this condition, the front portion 3 is folded back on the baby's torso, the hook members 31, 32 on both sides of the front portion 3 are engaged with the ring members 28, 28' or 29, 29' in the back portion 5. Thereby, the crotch portion 4 is composed in a bag-like form and the baby is held in the crotch portion.

Figure 3:
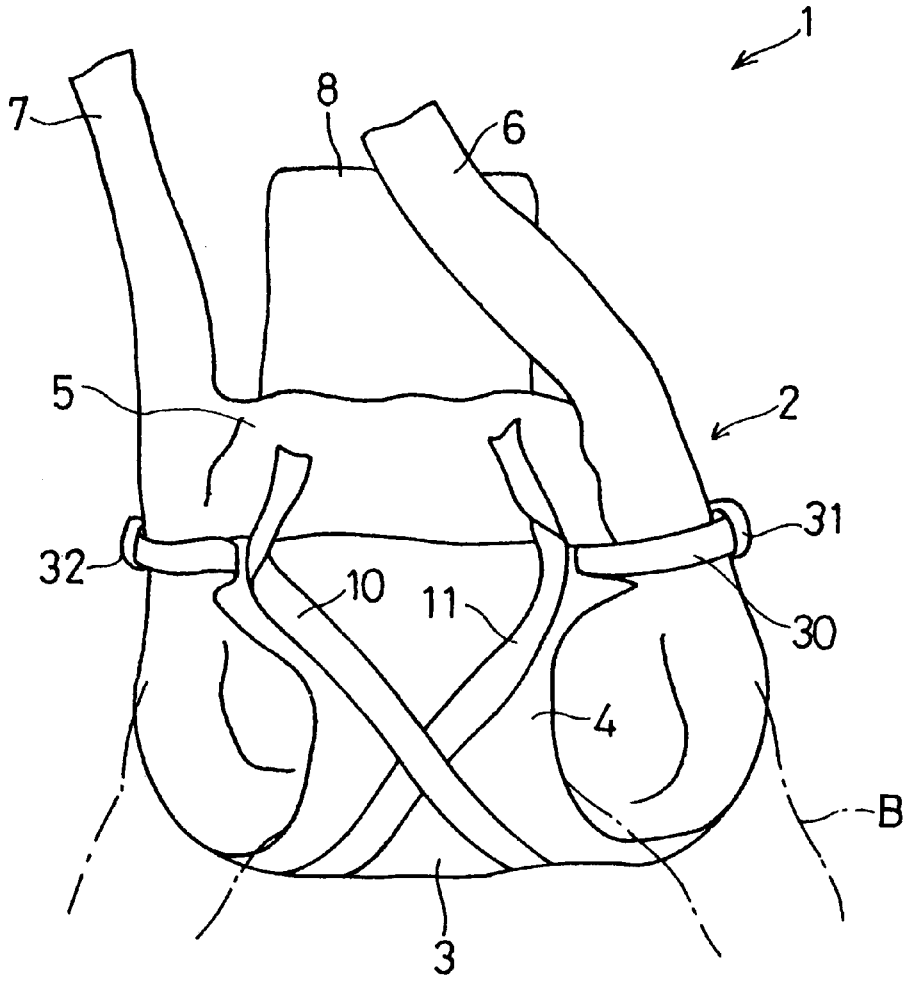
FIG. 3 is a top plan view of the assembled baby carrier.

At this time, as shown in FIG. 3, the crotch joint of a baby B is opened at a proper angle because of the narrow width of the crotch portion 4. This prevents damage to the crotch joint of the baby B when it is held in the baby carrier 1.

Then, the one-touch buckles 12, 13 at the top ends of the belt members 10, 11 are engaged with the corresponding buckles 20, 21 at the bottom ends of the belt members 10, 11, respectively. In this case, the one-touch buckles 12, 13 are engaged with the buckles 22, 23 with the covers 24, 25 of the buckles 20, 21 opened and after engagement, the covers 24, 25 are closed.

Figure 4:
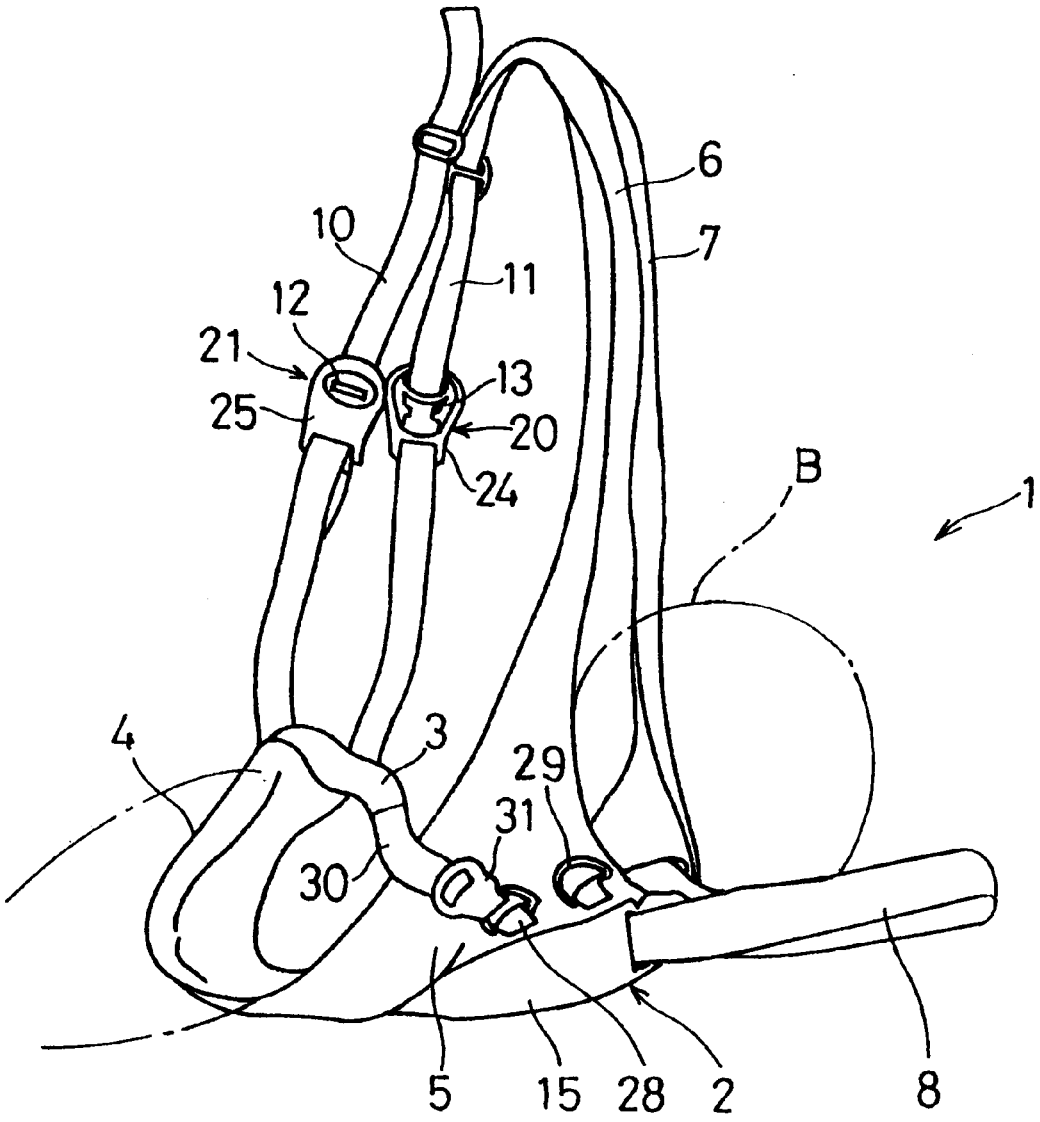
FIG. 4 is a side view of the assembled baby carrier.
Figure 5:
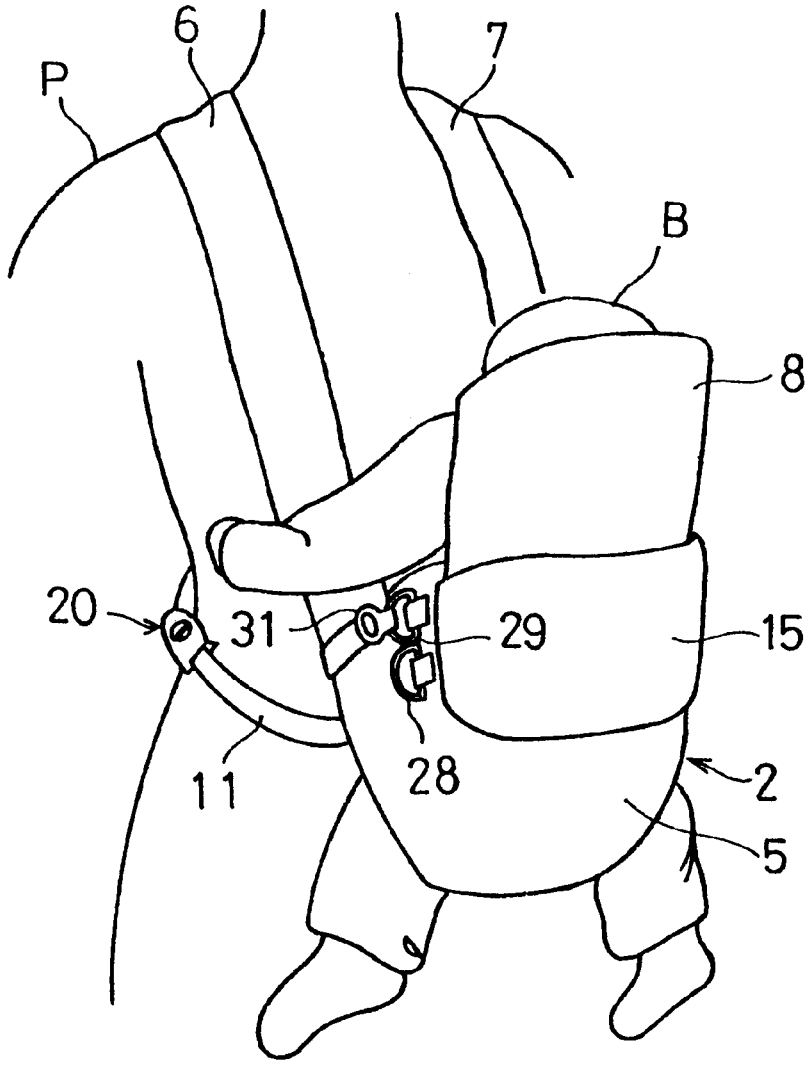
FIG. 5 is a perspective view of the baby carrier in use.
Figure 6:
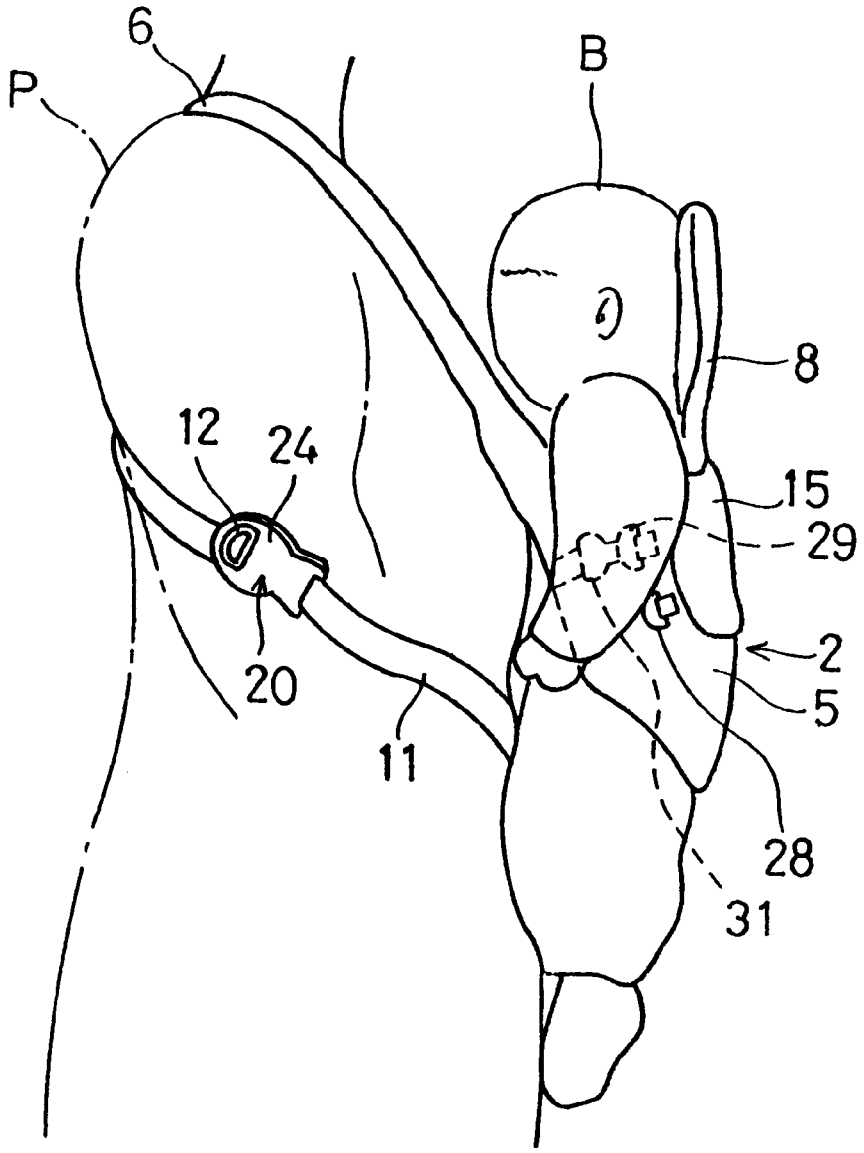
FIG. 6 is a side view of the baby carrier in use.
Figure 7:
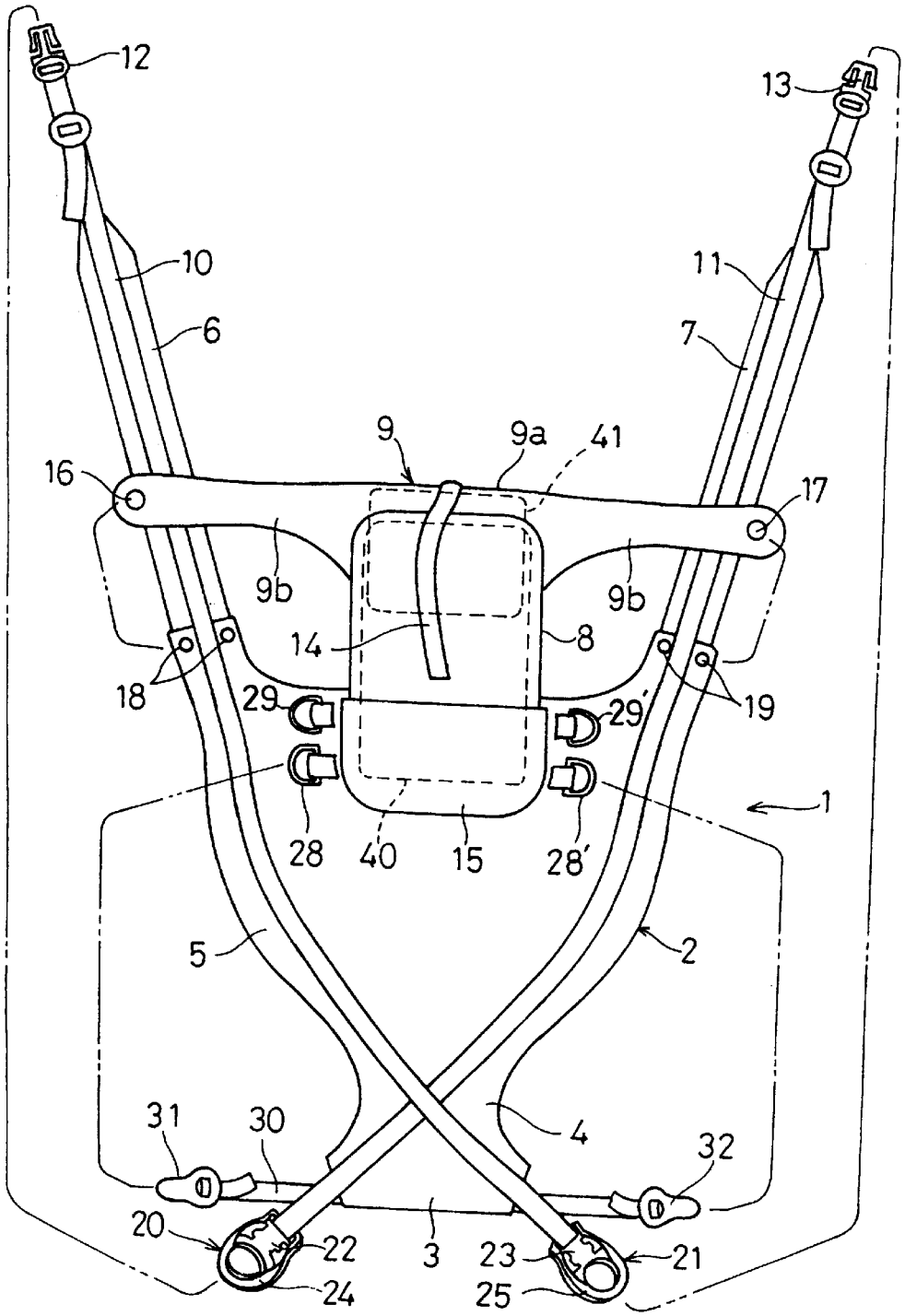
FIG. 7 is a front surface view of a baby carrier, in a developed state, according to the second embodiment of the present invention.
Figure 8:
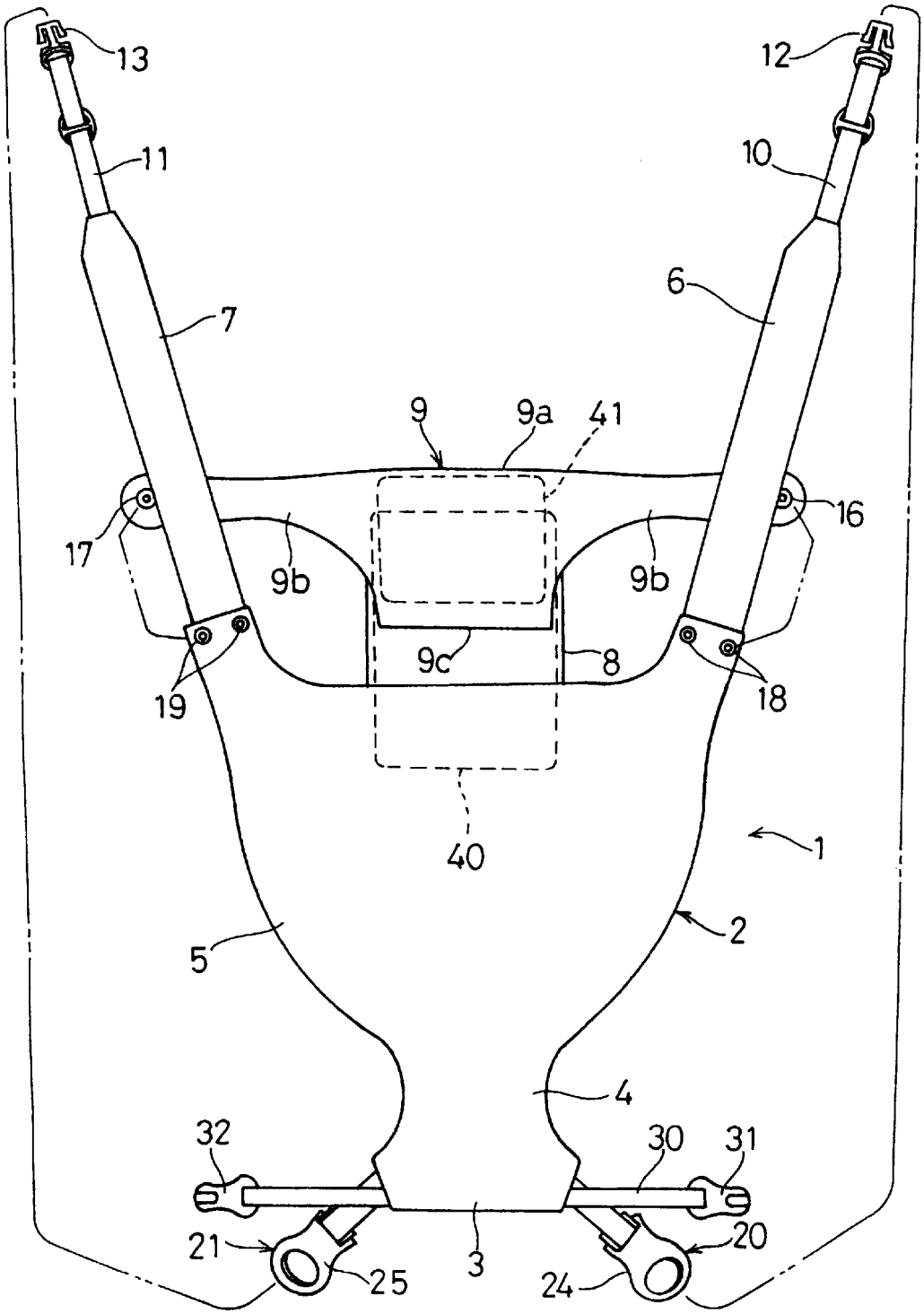
FIG. 8 is a back surface view of the baby carrier in a developed state.

Next, the baby nursing person holds two shoulder belts 6, 7, in her (or his) hands and lifts the baby carrier up (see FIG. 4). As shown in FIGS. 5 and 6, she places shoulder belts 6, 7 on her shoulders. In this manner, the baby carrier 1 is assembled and the baby is supported in the baby carrier 1.

According to this embodiment, when assembling the baby carrier 1 the nursing person has only to engage the hook members 31, 32 of the front portion 3 with the ring members 28, 28' or 29, 29' of the back portion 5. Therefore, the assembly work becomes simple.Moreover, since the baby carrier 1 can be assembled with the baby placed on the carrier body 2, the work load of the baby nursing person becomes lighter.

Furthermore, since the shoulder belts 6, 7 are placed not on the side of the front portion 3 but on the side of the back portion 5 the shoulder belts 6, 7 will not be in the way when engaging the hook members 31, 32 with the ring members 28, 28', thus making the assembly work much easier.

FIGS. 7–15 show the baby carrier of the second embodiment of the present invention. In this embodiment, a head support 9 is connected to the headrest 8 and the head support 9 is comprised of a head support body 9*a* and band-form portions 9*b* extending in a band-like form on both sides of the head support body 9*a*. The head support body 9*a* is positioned partially overlapped on the headrest 8 on the side of the placement of the baby's head and only its bottom end 9*c* is connected to the headrest 8. Thereby, the head support body 9*a* is rotatable around its bottom end 9*c*.

Snap fasteners 16, 17 are attached to the tips of the band-like portions 9*b* and these fasteners 16, 17 can be detachable to snap fasteners 18, 19, provided at opposite ends of the upper portion of the back portion 5. In addition, the fasteners 18, 19 may be provided at the bottom of the shoulder belts 6, 7.

The length of the band-like portions 9*b* and the position of the fasteners 18, 19 are preset such that when the shoulder belts 6, 7 are placed on the shoulder of the nursing person, the head support body 9*a* rotates and stands upward at an angle from the headrest 8, and thereby the head support body 9*a* supports the top of the baby's head. In addition, a core 41 that overlaps with core 40 in the headrest 8 is inserted into the head support body 9*a*.

The top and bottom ends of a belt member 14 are connected to the top of the head support body 9*a* and the lower part of the head rest 8. The belt member 14 has such a sufficient length that the belt member 14 will not prevent the rotational movement of the head support body 9*a*.

Additionally, the ring members 28, 28' are used for side supporting of a baby and the ring members 29, 29' are used for up/down supporting of a baby. The number of ring members is not limited to this embodiment and multiple pairs of ring members for both side and up/down holding may be provided.

When holding a baby in the baby carrier 1, first, the baby is placed on the carrier body 2. In this condition, the front portion 3 is folded back on the baby's torso and the hook members 31, 32 on both sides of the front portion 3 are engaged with the corresponding ring members 28, 28' or 29, 29' in the back portion 5. Thereby, the crotch portion 4 is formed in a bag form and the baby's crotch is held in the crotch portion 4.

In this case, when the baby carrier 1 is used for side supporting, the hook members 31, 32 on the side of the front portion 3, are engaged with the ring members 28, 28' on the lower side of the back portion 5. Thereby, the center of gravity of the baby is positioned in the lower part of the carrier body 2 for stable side holding of the baby.

When the baby carrier 1 is used for up/down holding type, the hook members 31, 32 are engaged with the upper ring members 29, 29'. Thereby, the crotch opening portion of the carrier body 2 can be enlarged, and as a result, the crotch joint of the baby is not harmed when it is held in the up/down direction.

Figure 9:
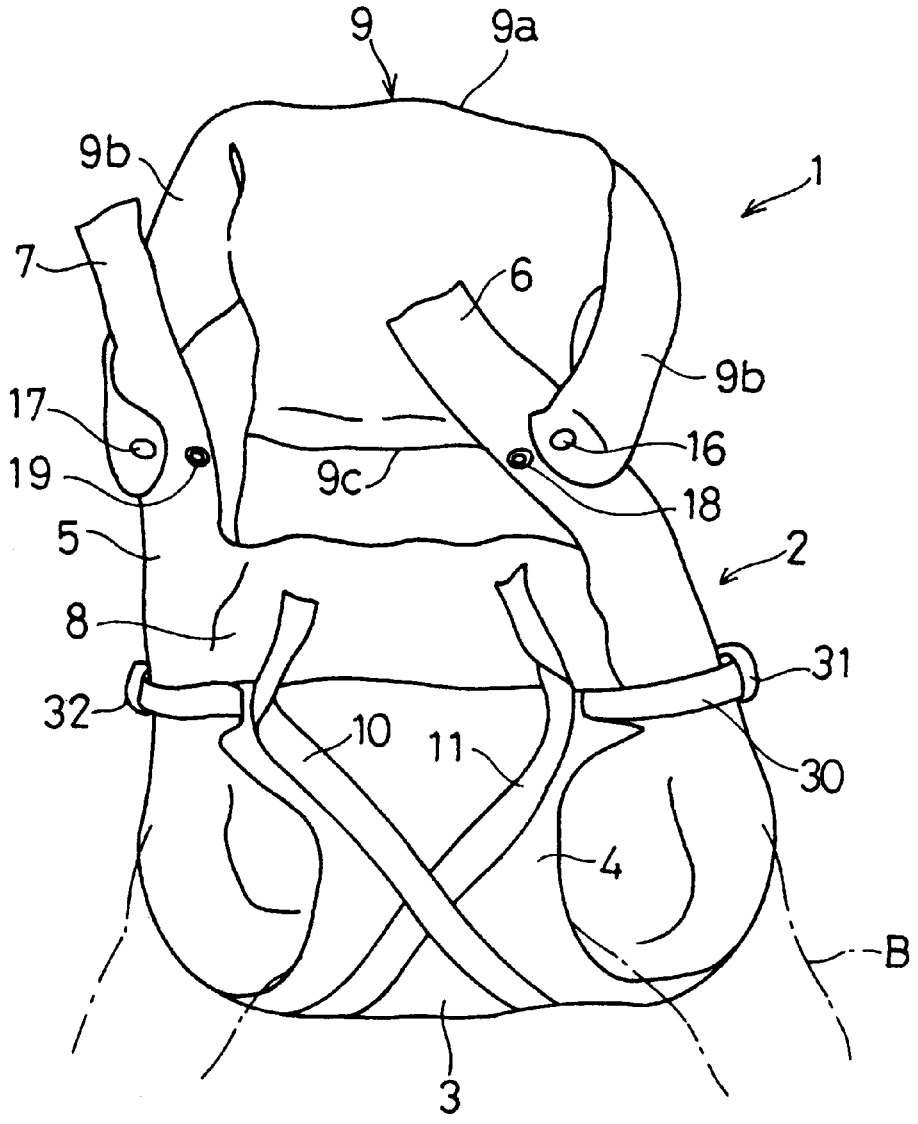
FIG. 9 is a top plan view of the assembled baby carrier.
Figure 10:
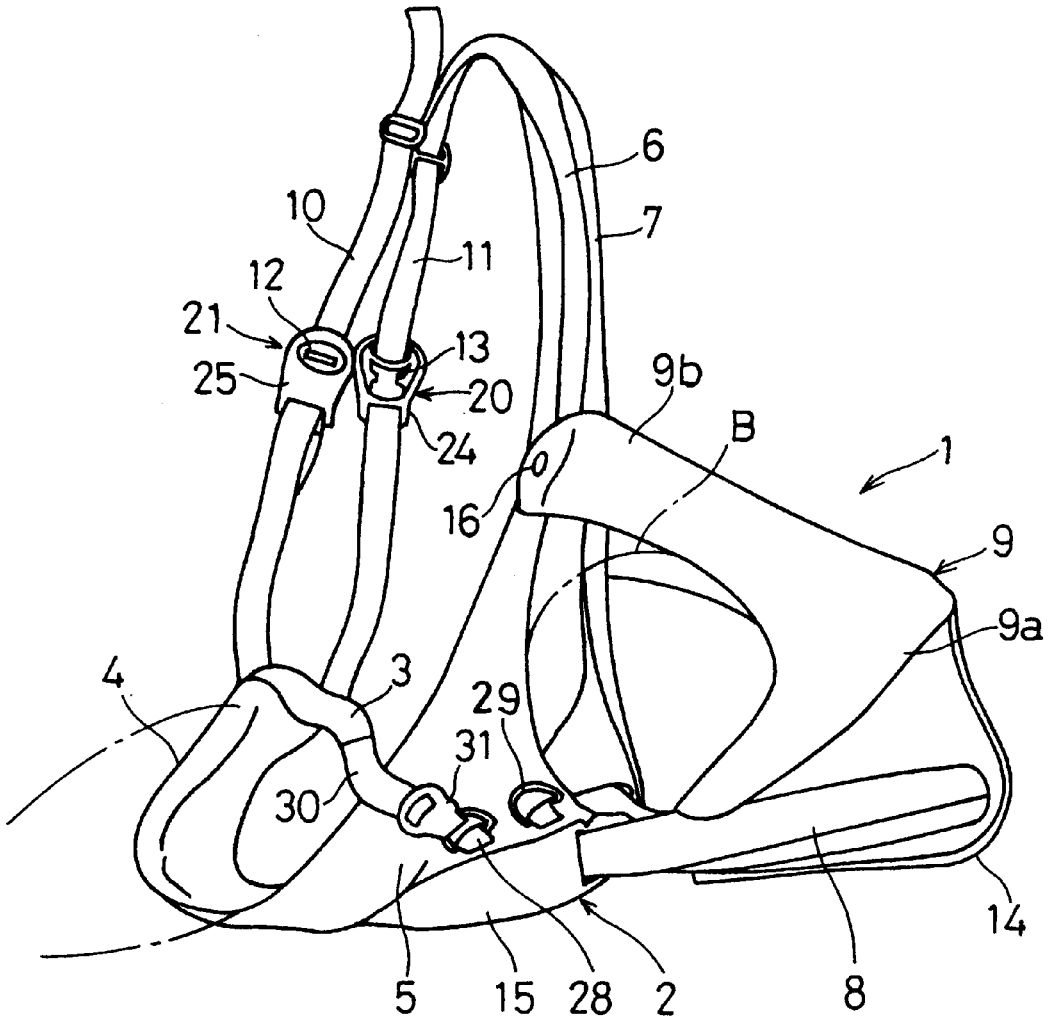
FIG. 10 is a side view of the assembled baby carrier.

Next, the snap fasteners 16, 17 at the tips of the band-like portions 9*b* of the head support 9 are engaged with the corresponding fasteners 18, 19 of the two pairs of fasteners on the side of the back portion (see FIG. 9). At this time, the appropriate fasteners 18, 19 are properly selected according to the size of the head or body of the baby to be held.

One-touch buckles 12, 13 at the top ends of the belt members 10, 11 are engaged with the corresponding one-touch buckles 20, 21 with covers at the bottom ends of the belt members 10, 11. In this manner, one-touch buckles 12, 13 are engaged with one-touch buckles 22, 23 while the covers 24, 25 are opened and thereafter, the covers 24, 25 are closed. The baby carrier 1 is assembled in this manner and the baby is held in the baby carrier 1.

Figure 11:
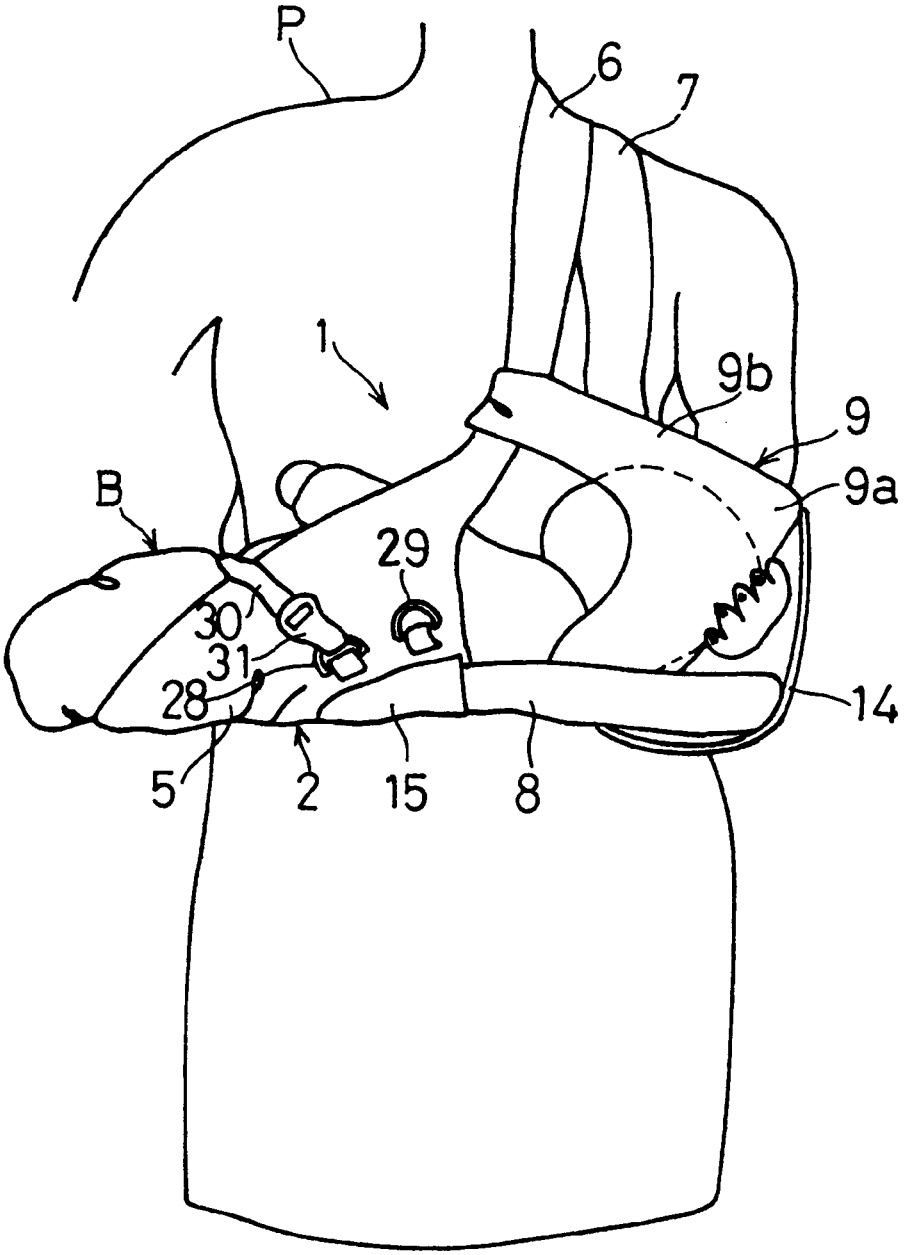
FIG. 11 is a schematic illustrating a baby carrier used as a side holding type.

Next, when the baby carrier 1 is used for side holding type, two shoulder belts 6, 7 are bundled, together the baby carrier 1 is lifted up (see FIG. 10), and as shown in FIG. 11, both shoulder belts 6, 7 are placed at an angle on one shoulder of the baby nursing person P. At this time, since the crotch of the baby B is held in the crotch portion 4 in a bag-form as mentioned above the baby B does not fall down from the lower part of the carrier body 2.

Figure 12:
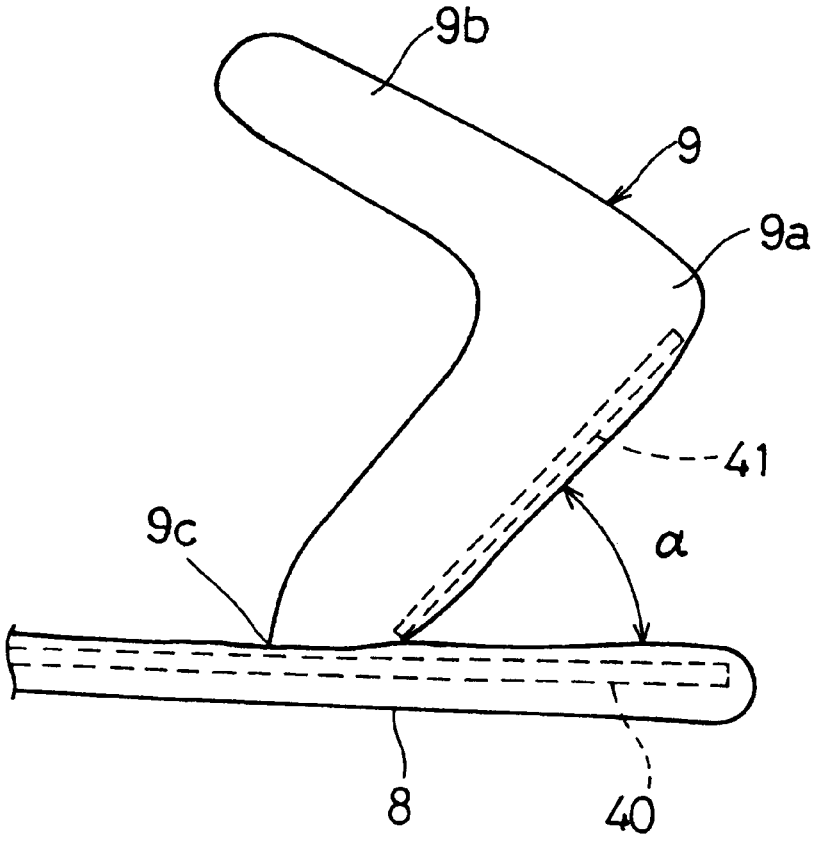
FIG. 12 is a side view showing the position relationship between the head support body and headrest while the baby carrier is in use.

Furthermore, when the shoulder belts 6, 7 are placed on the shoulder of the nursing person P, the head support body 9*a* stands up from the headrest 8 and around its bottom part 9*c* (see FIG. 12), and forms the angle $\alpha$ (see FIG. 12). Therefore, the top of the baby B's head is protected by this head support body 9*a* and the sides of the baby B's head are supported by the band-like portions 9*b*, too. In addition, in this case, the cores 40, 41 are inserted in the headrest 8 and the head support body 9*a*, so that the back of the baby B is held in a more stretched manner. As shown in FIG. 11, when baby carrier 1 is in use the nursing person P can place her hand from the outside of the head support body 9*a*.

Figure 13:
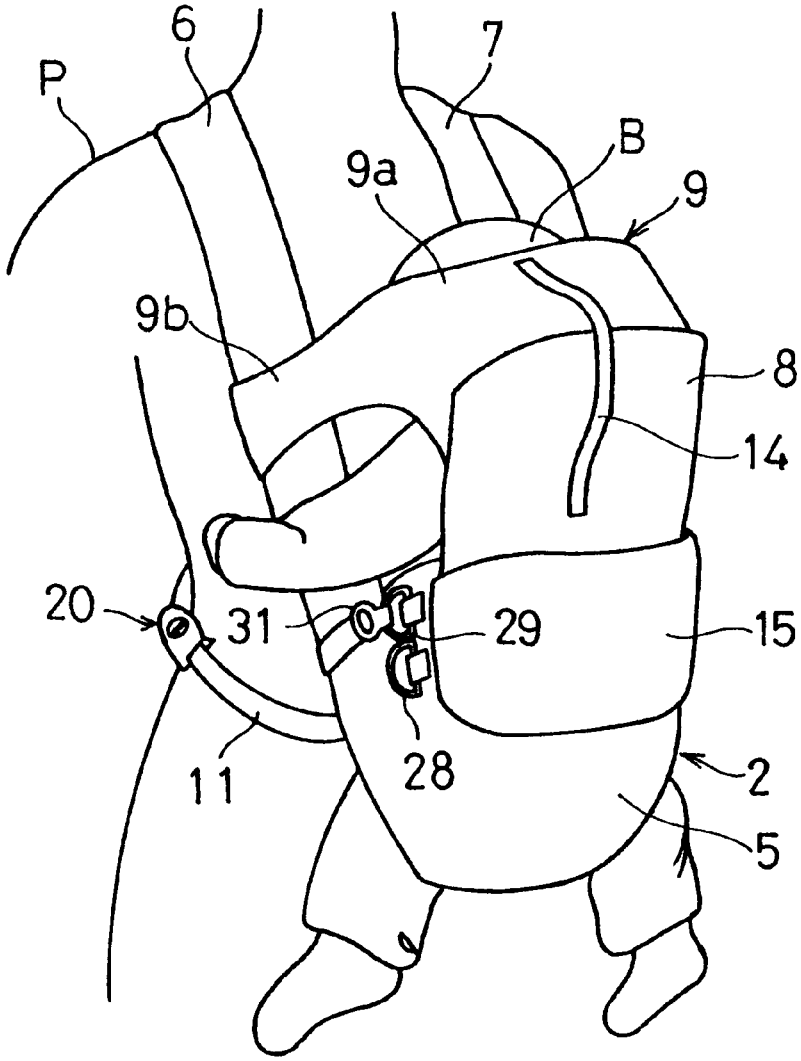
FIG. 13 is a perspective view of the baby carrier in use for an up/down holding type.
Figure 14:
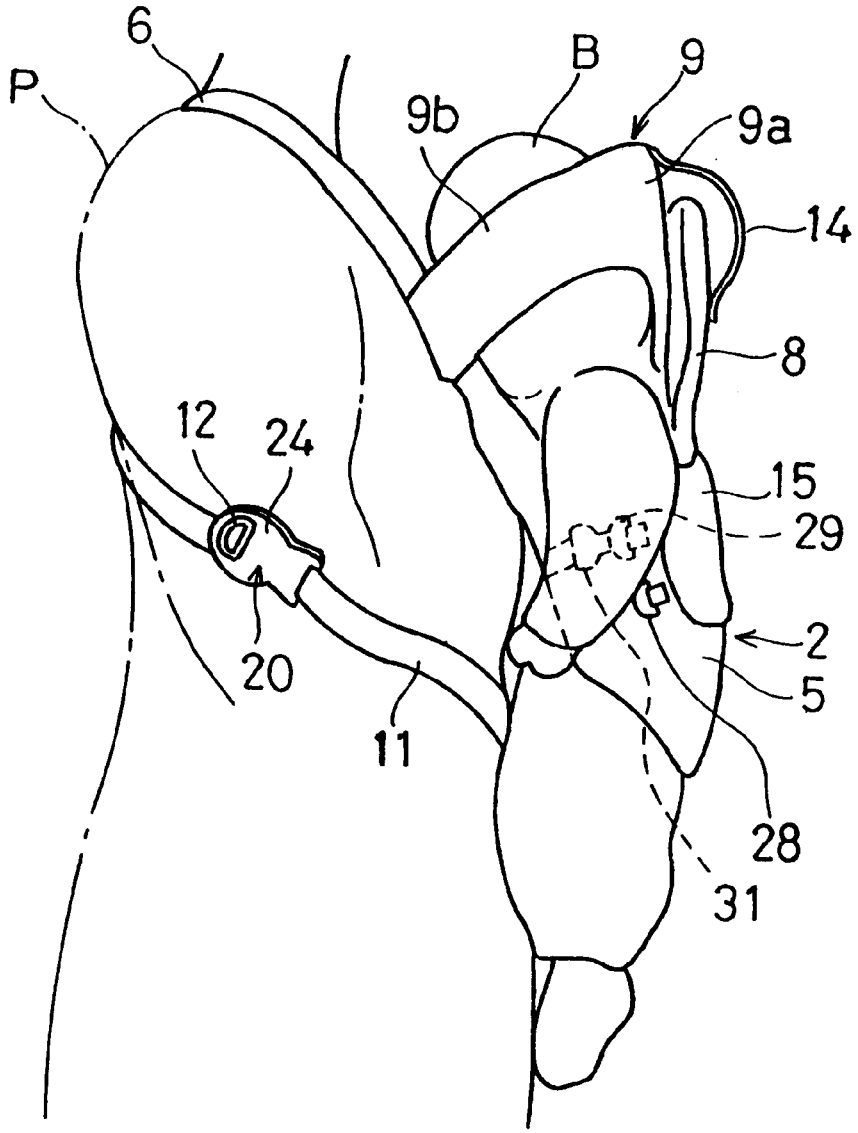
FIG. 14 is a side view of the baby carrier in use for an up/down holding type.
Figure 15:
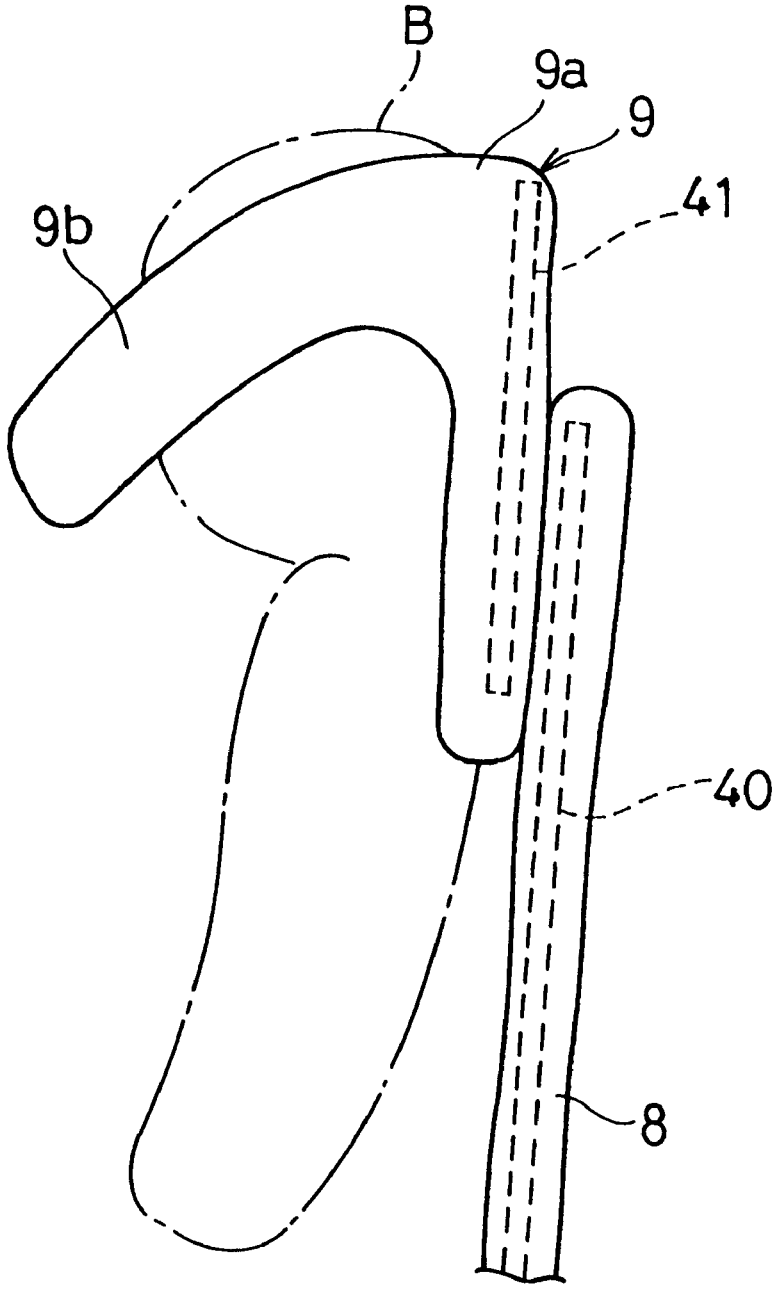
FIG. 15 is a side view showing the position of the head support body and headrest in FIGS. 13 and 14.
Figure 16:
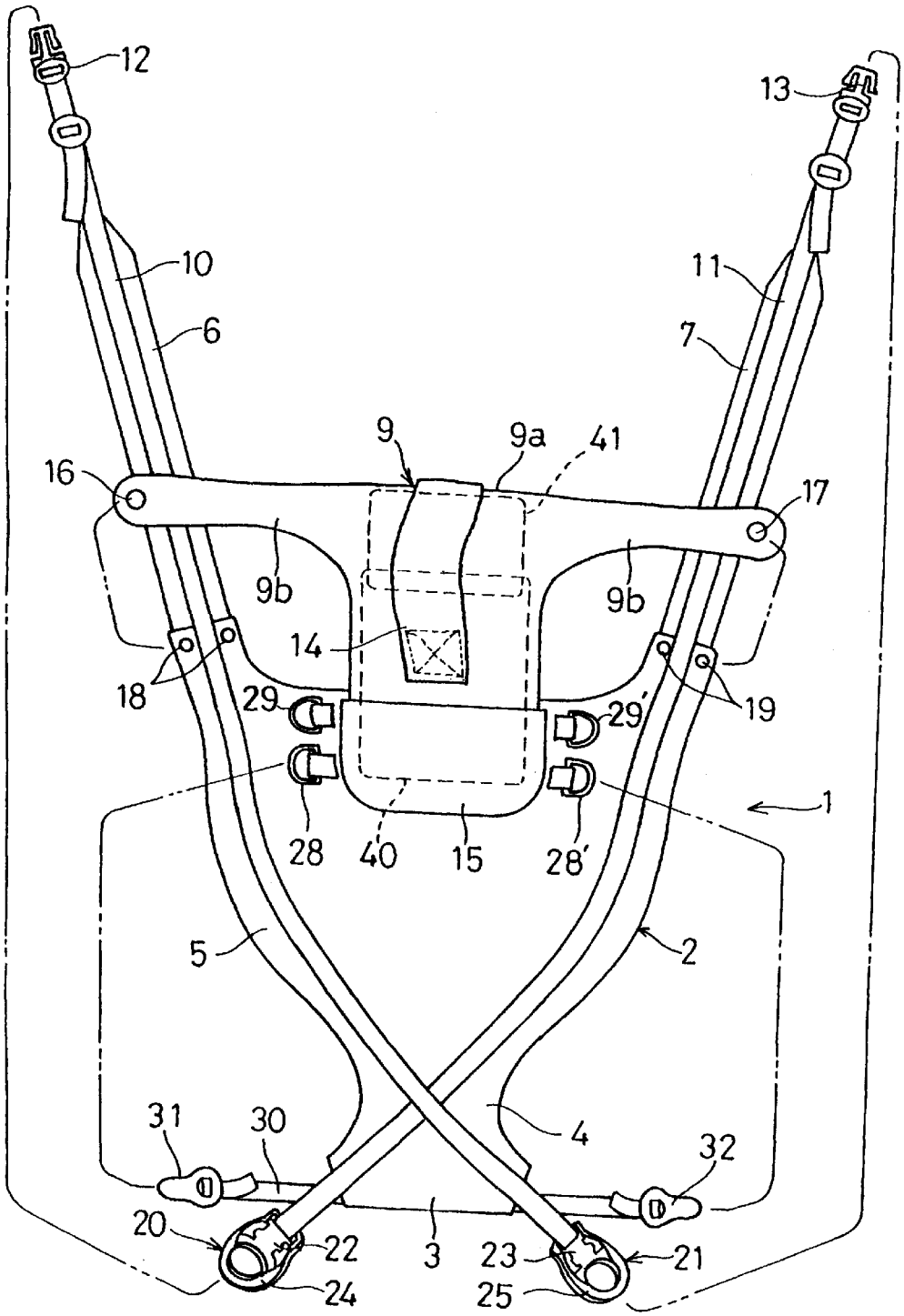
FIG. 16 is a front view of the developed baby carrier of the third embodiment of the present invention.
Figure 17:
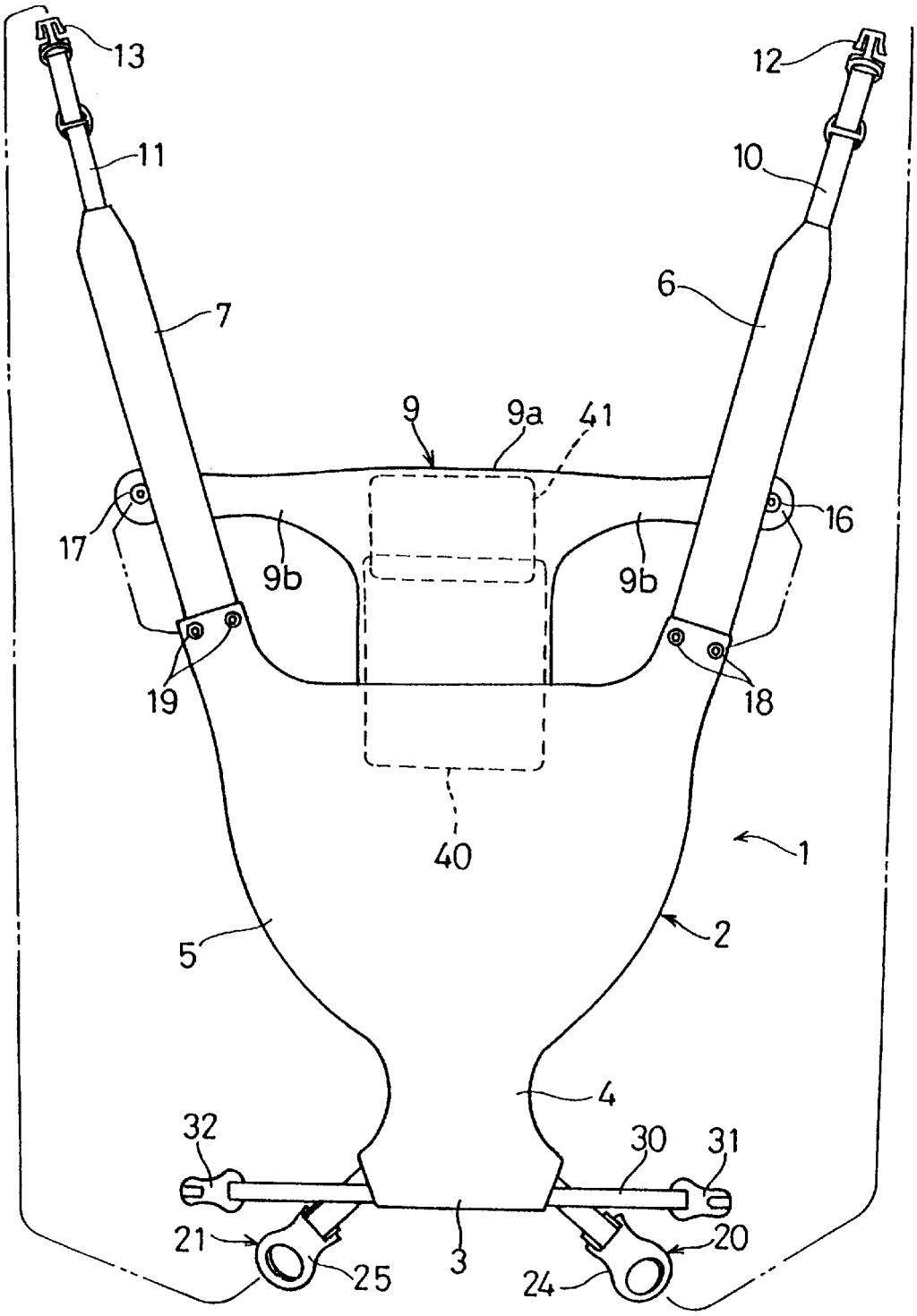
FIG. 17 is a rear view of the developed baby carrier.

On the other hand, when the baby carrier 1 is used for up/down holding, the shoulder belts 6, 7 are cross-hung from the shoulders of the baby nursing person (see FIGS. 13 and 14). At this time, as shown in FIG. 15, the head support body 9*a* is positioned integrally overlapped with the headrest 8 and the rear portion or back of the baby B's head is supported by the head support body 9*a* and the headrest 8.

Furthermore, at this time, cores 40, 41 that mutually overlap one another are inserted in the head support body 9*a* so that the weight of the baby B's head that acts on the head support body 9*a* is born by the overlapped part of the cores 40, 41.

Next, when the baby carrier 1 is switched from side holding type to up/down holding type the hook members 31, 32 are removed from the ring members 28, 28' and instead are engaged with the ring members 29, 29'. On the contrary, when switching from up/down holding type to side holding type the hook members 31, 32 are removed from the ring members 29, 29' and instead are engaged with the ring members 28, 28'. Thus, switching between side holding and up/down holding can be performed simply by engaging/disengaging the hook members 31, 32 with/from the ring members 28, 28', 29, 29'.

As mentioned above, according to this embodiment, switching between side holding and up/down holding can be performed very easily. In addition, when the baby is held sideways, the baby's crotch is held by the bag form crotch portion and the baby's head is supported by the head support body that stands up at an angle from the headrest. Therefore, falling down of the baby during side holding can be prevented and the baby's head can be supported stably and firmly by the headrest 8 and the head support 9.

FIGS. 16–22 show the baby carrier of the third embodiment of the present invention. The head support 9 for supporting of the baby's head is connected to the upper part of the back portion 5. The head support 9 is composed of the head support body 9*a* and the band-like extending portions 9*b*. The lower part of the head support body 9*a* is attached to the inside of the pocket 15 provided the back portion 5 via adhesive cloth (or surface fastener) or the like. First and second cores 40, 41 are inserted in the head support body 9*a*. The top end of the first core 40 and the bottom end of the second core 41 overlap each other.

Snap fasteners 16, 17 are attached to the tip of the band-like portions 9*b* and these fasteners 16, 17 can engage detachably with fasteners 18, 19 attached to the opposite ends of the back portion 5. Fasteners 18, 19 may be attached to the lower part of the shoulder belts 6, 7.

A belt piece 14 extending in the up/down direction across the overlapped part of the cores 40, 41 is provided on the surface of the head support 9. The top and bottom ends of the belt piece 14 are connected to the top and center of the head support body 9*a*. The belt piece 14 guides the hand of the baby nursing person when side-supporting the baby.

Figure 18:
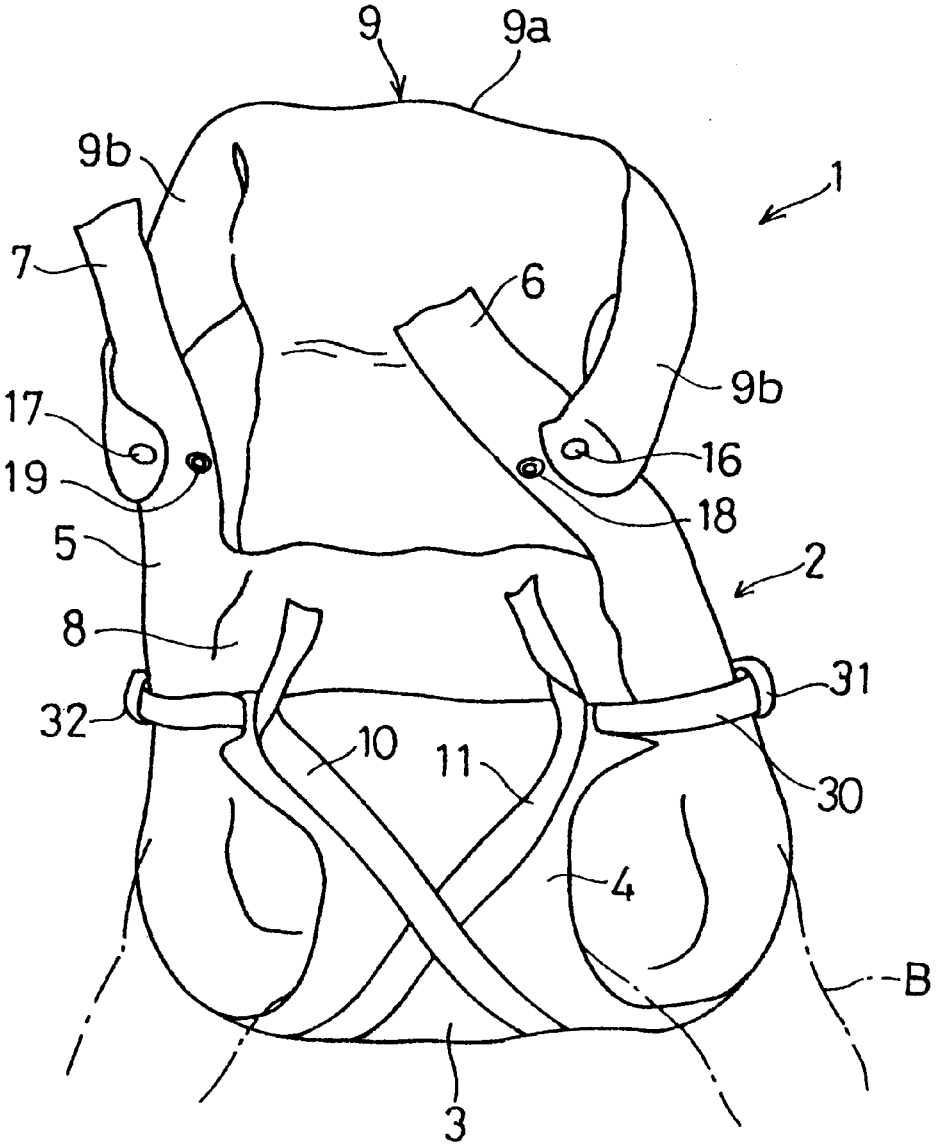
FIG. 18 is a top plan view of the assembled baby carrier.
Figure 19:
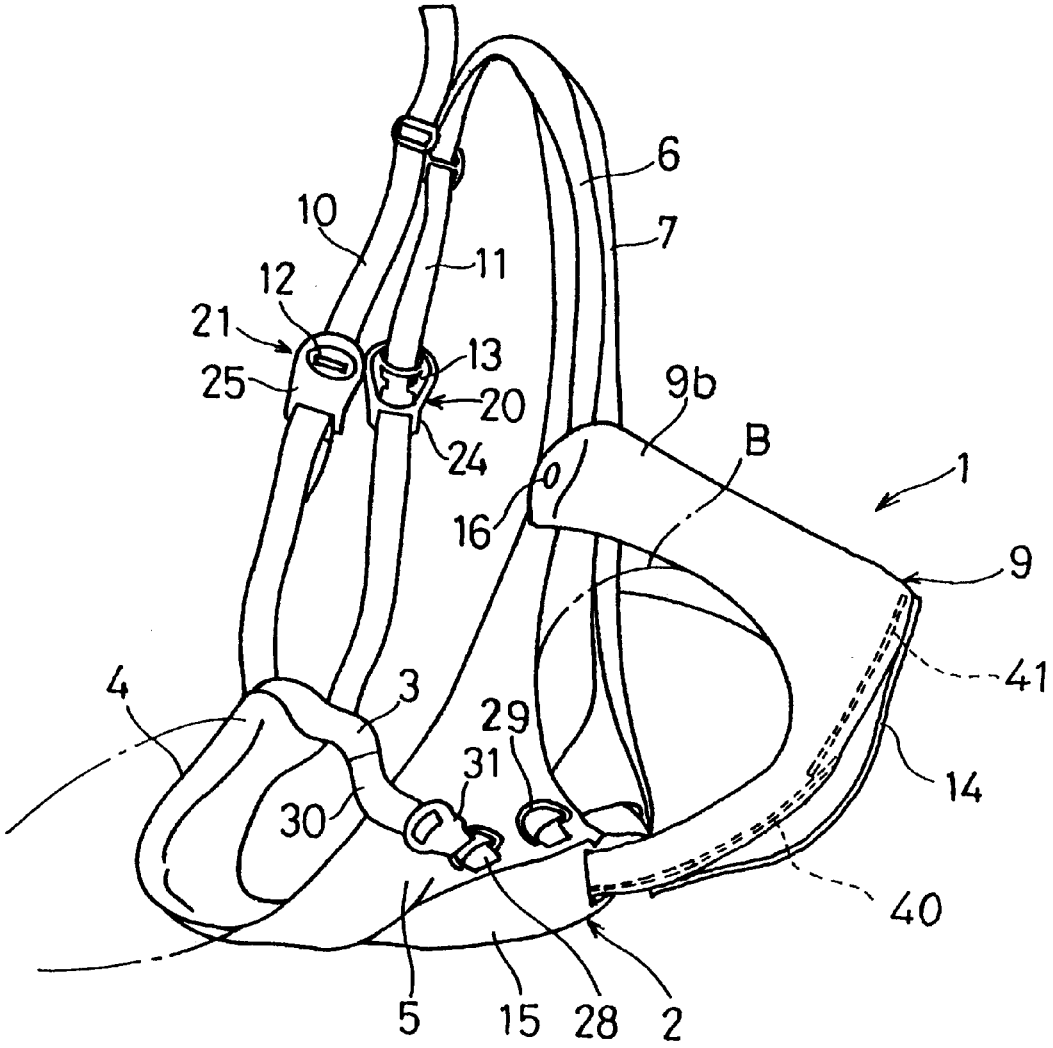
FIG. 19 is a side view of the assembled baby carrier.
Figure 20:
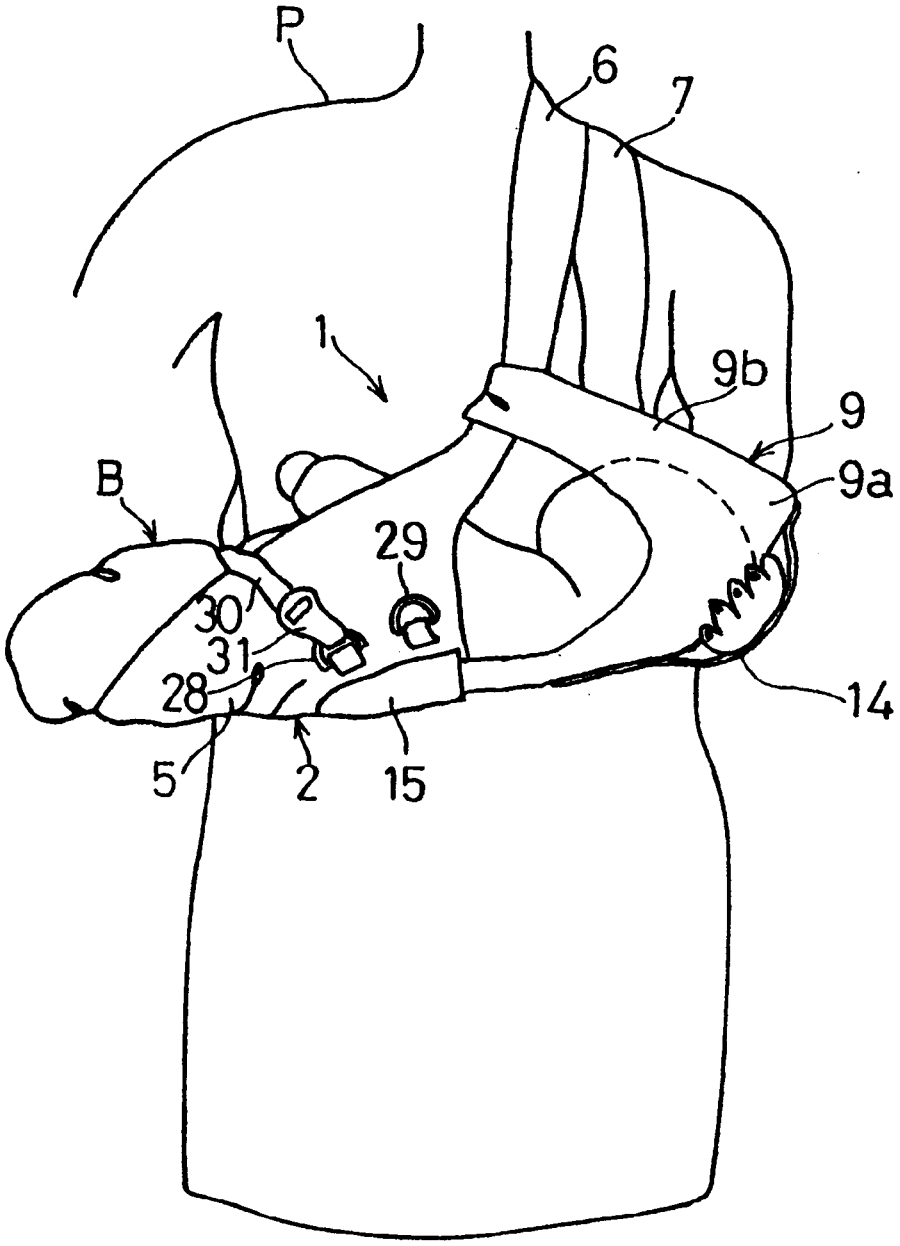
FIG. 20 is a schematic illustrating a baby carrier in use.

The assembly of the baby carrier 1 is similar to that of the second embodiment. When an assembled baby carrier 1 shown in FIG. 18 is used for side holding type, the cores 40, 41 in the head support 9 change their intersection angle according to the size of the head or tilting of the neck of the baby B.

For example, when the head of the baby B is relatively small the angle becomes greater (see FIG. 19) and the head support surface of the head support 9 is bent along the head of the baby. On the contrary, when the head of the baby B is relatively large the angle becomes smaller and the head support surface of the head support 9 becomes flatter (not shown).

In this manner the head support 9 can fit the head of the baby B for stable supporting of the head of the baby. Furthermore, in this case, when the nursing person puts her hand between the belt piece 14 and the head support 9 the head of the baby can be more stably supported (see FIG. 20).

In addition, since the first and second cores 40, 41 are partially overlapped when the baby B is held in the baby carrier 1, the head support 9 bends downward less and thereby, the head of the baby B is more firmly supported by the head support 9.

Figure 21:
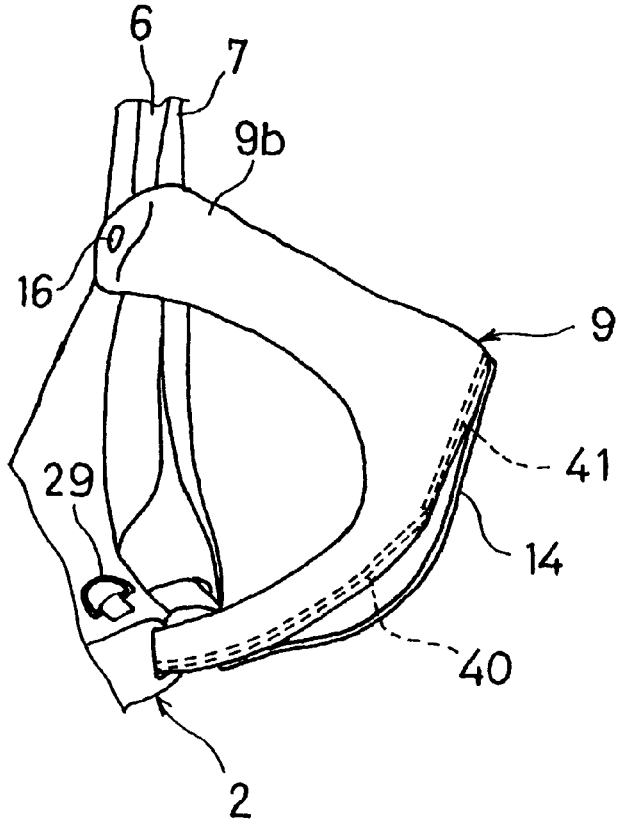
FIG. 21 is a schematic illustrating a modification of the head support of the baby carrier.

The first and second cores 40, 41 do not necessarily overlap. In this case, when the baby is held in the baby carrier, the cores 40, 41 intersect, as shown in FIG. 21 and the head support surface of the head support bends.

Figure 22:
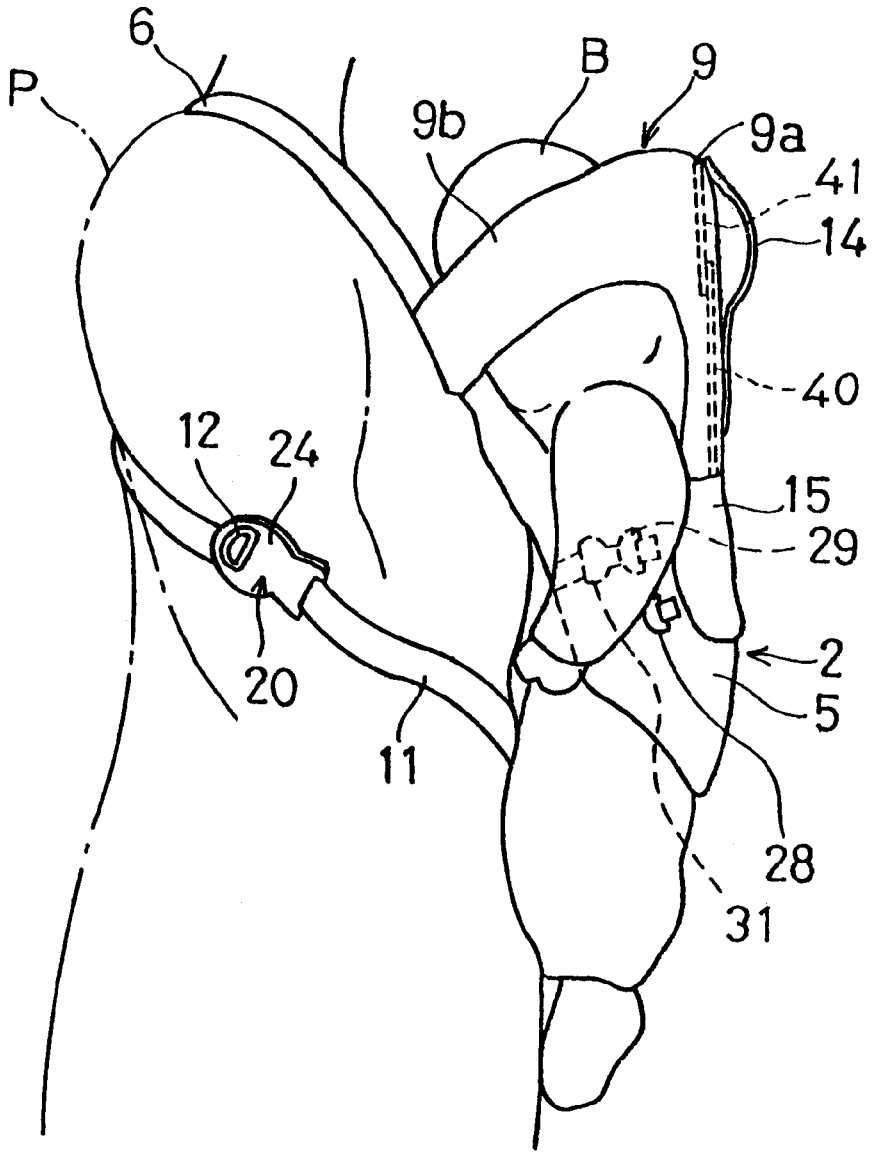
FIG. 22 is a side view of a baby carrier in another use.
Figure 23:
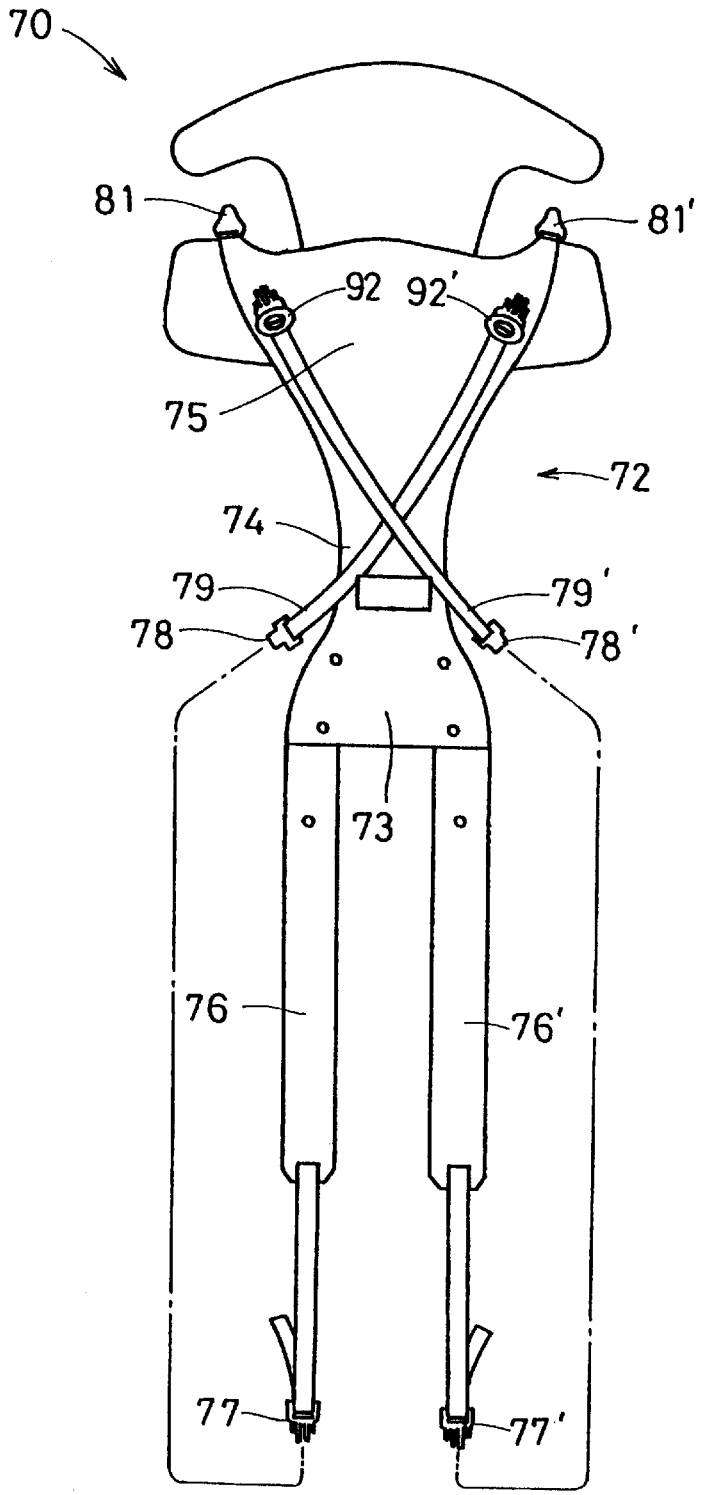
FIG. 23 PRIOR ART
FIG. 23 is a front view of the developed baby carrier of the prior art.
Figure 24:
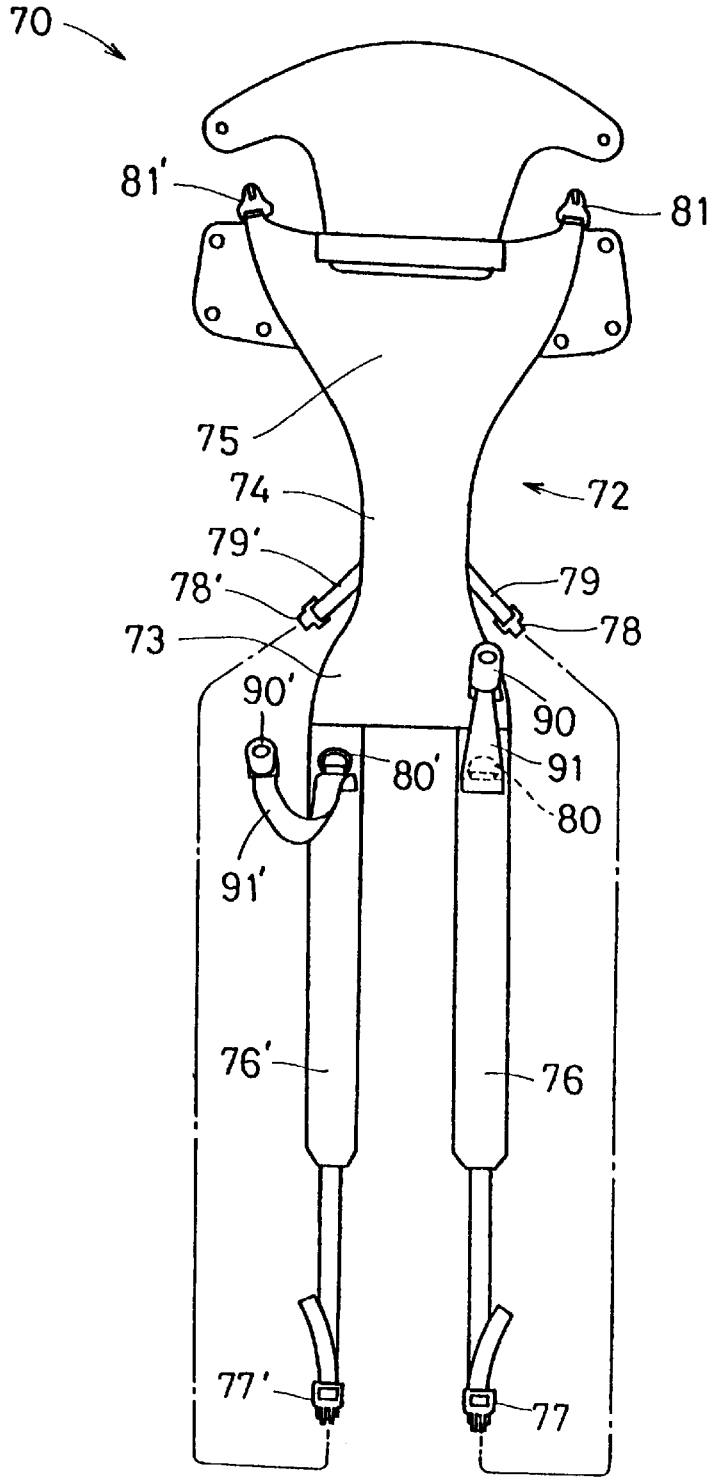
FIG. 24 PRIOR ART
FIG. 24 is a rear view of the developed baby carrier of the prior art.
Figure 25:
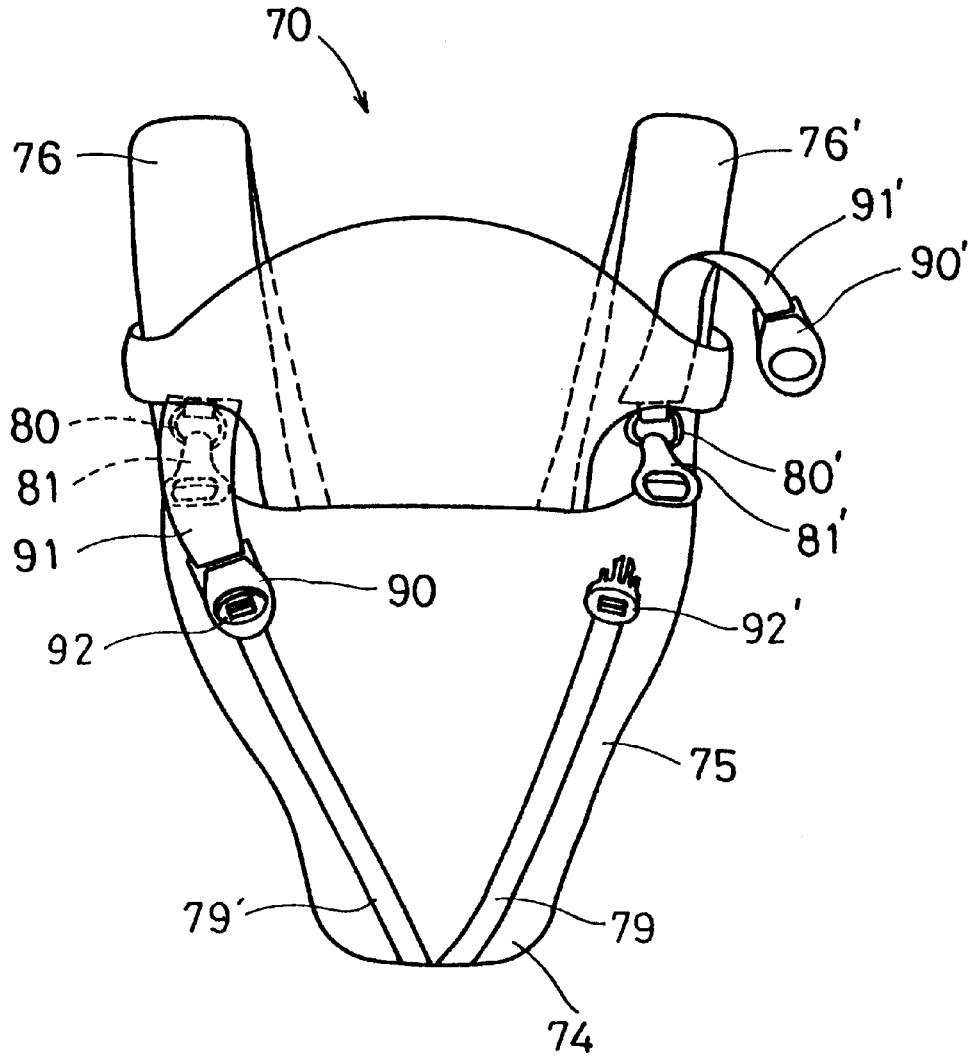
FIG. 25 PRIOR ART
FIG. 25 is a front elevational view of an assembled baby carrier of the prior art.
Figure 26:
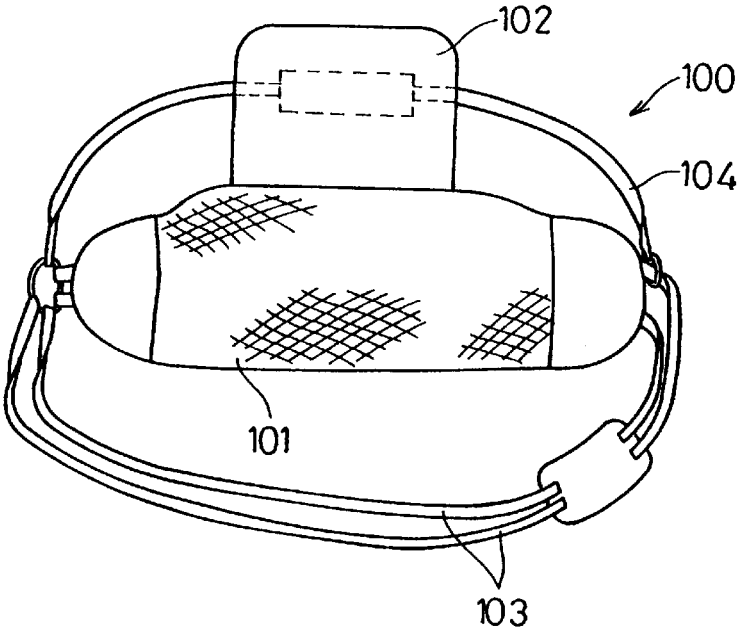
FIG. 26 PRIOR ART
FIG. 26 is a front elevational view of a net type baby carrier.
Figure 27:
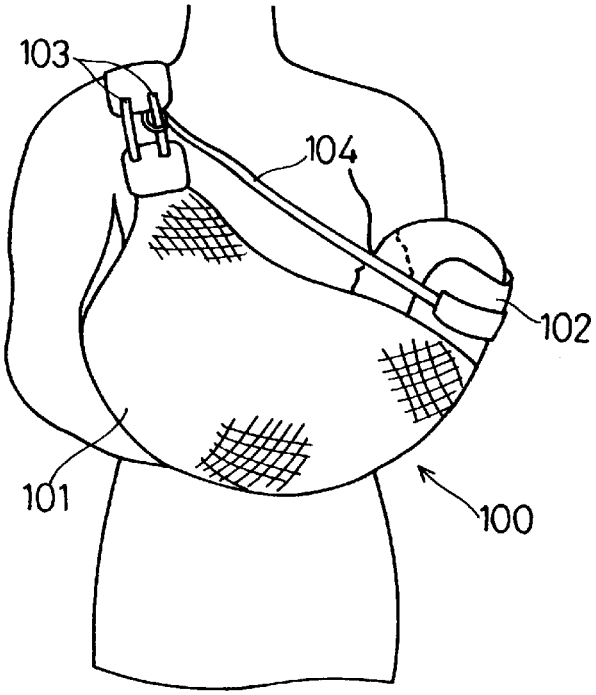
FIG. 27 PRIOR ART
FIG. 27 is a schematic illustrating a net type baby carrier in use.
Figure 28:
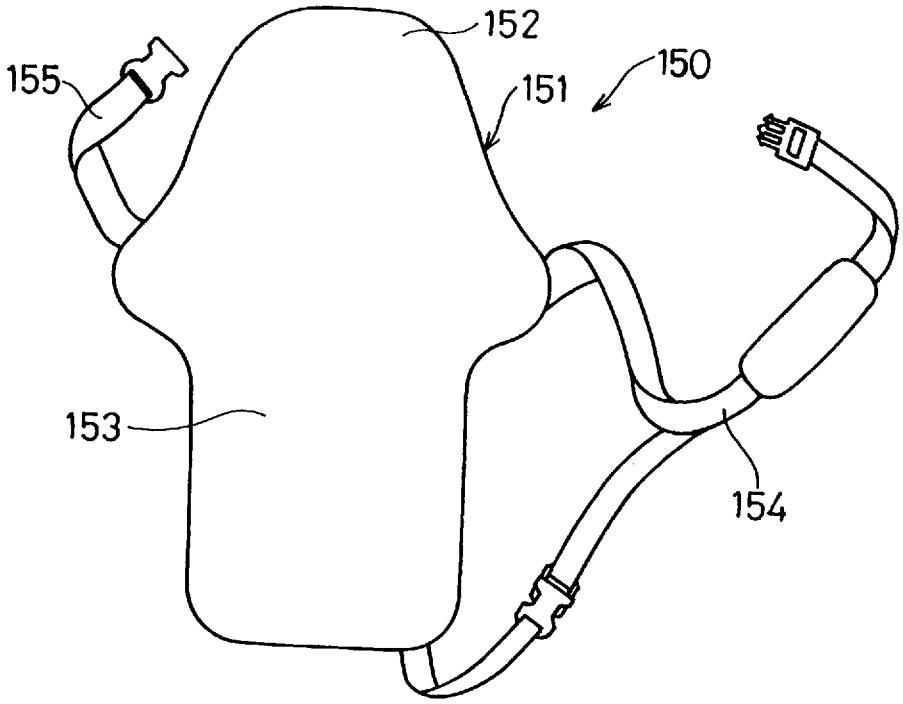
FIG. 28 PRIOR ART
FIG. 28 is a front view of an integral carrier type baby carrier of the prior art.
Figure 29:
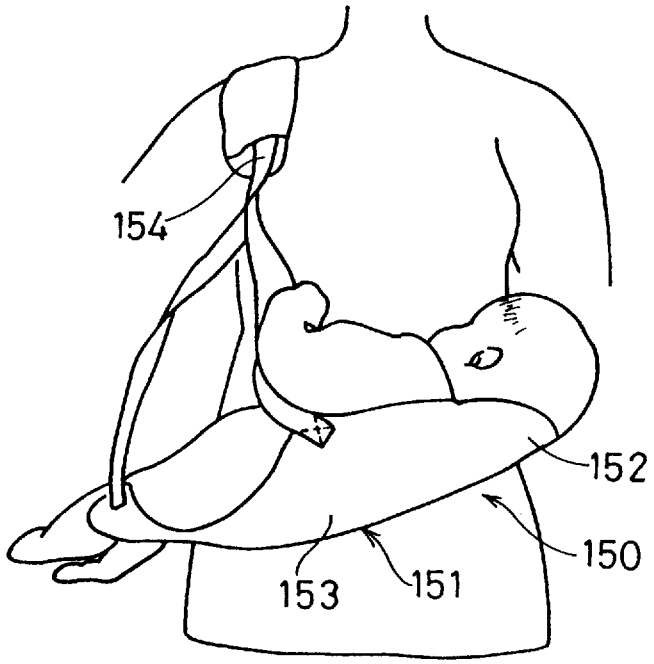
FIG. 29 PRIOR ART
FIG. 29 is a schematic illustrating an integral carrier type baby carrier of the prior art in use.
Figure 30:
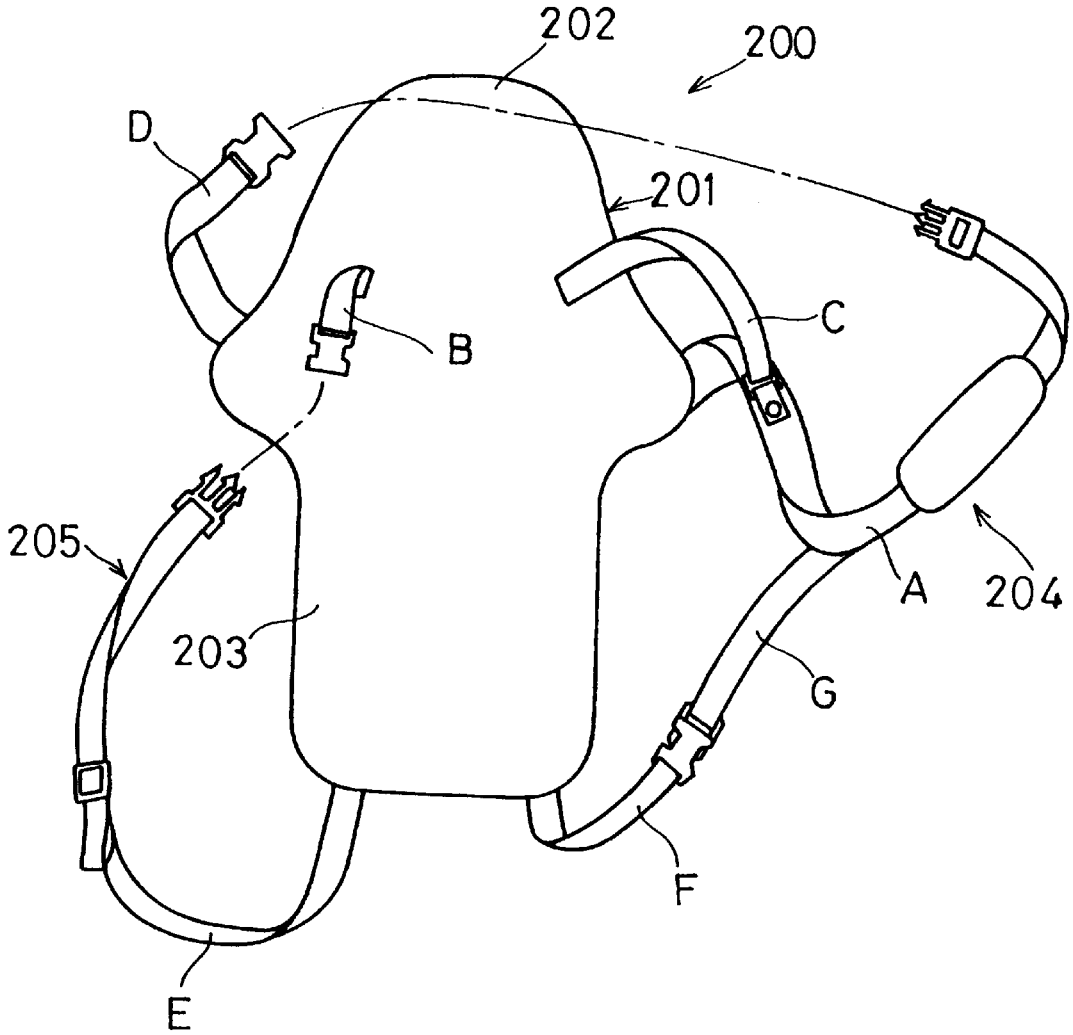
FIG. 30 PRIOR ART
FIG. 30 is a front view of a side holding type baby carrier of the prior art in use, in a developed state.
Figure 31:
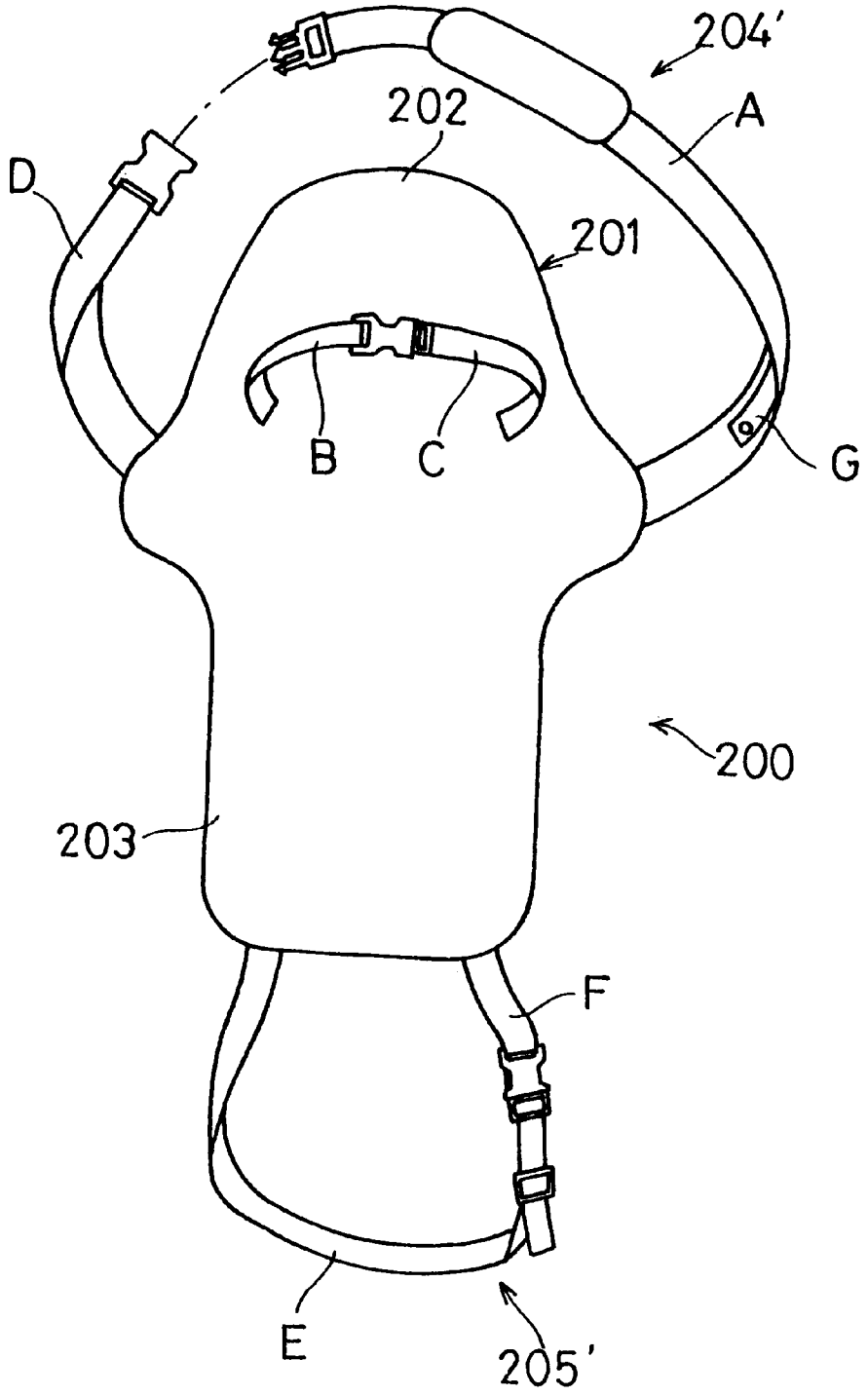
FIG. 31 PRIOR ART
FIG. 31 is a front view of an up/down holding type baby carrier of the prior art in use, in a developed state.
Figure 32:
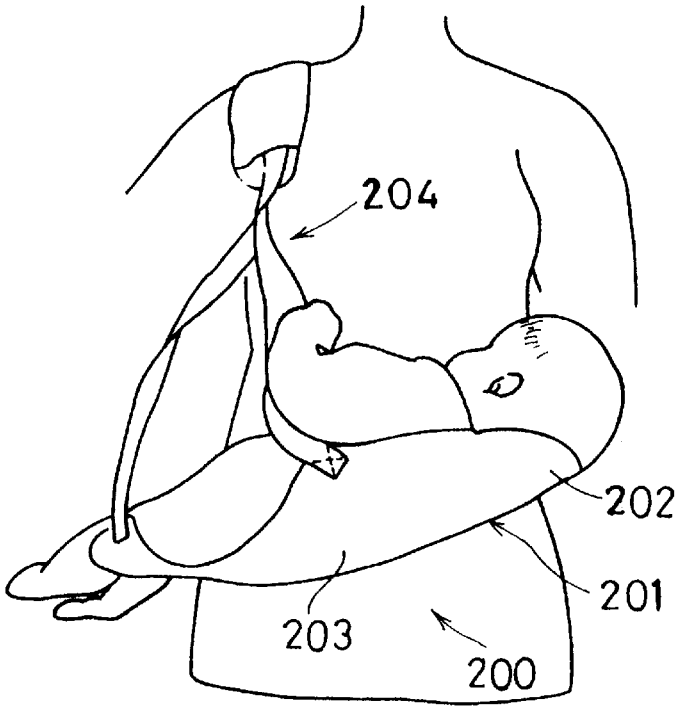
FIG. 32 PRIOR ART
FIG. 32 is a schematic illustrating a side holding type baby carrier of the prior art in use.
Figure 33:
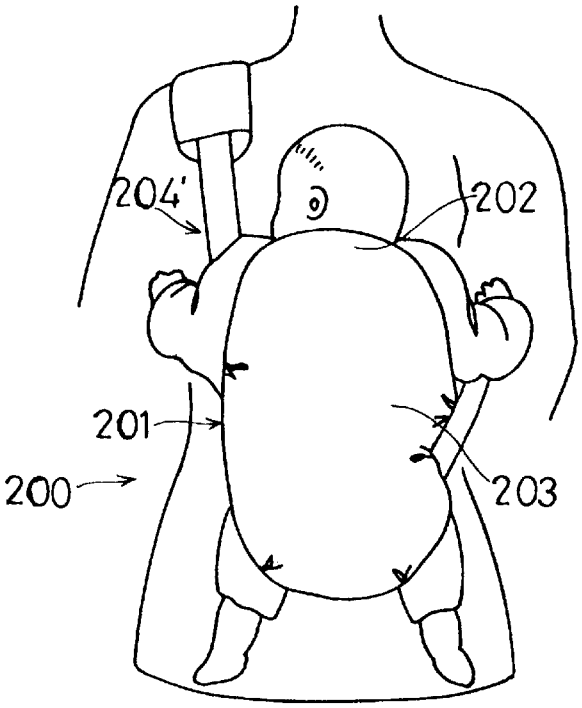
FIG. 33 PRIOR ART
FIG. 33 is an up/down holding type baby carrier of the prior art in use.

Furthermore, as shown in FIG. 22, the baby carrier 1 can be used for up/down holding. In such a case, the first and second cores 40, 41 are positioned on a nearly straight line and the head support surface of the head support 9 is nearly flat.

The above-mentioned baby carriers are only examples, and therefore, this invention can be applied to baby carriers in various modes as long as the baby carrier has a carrier body.

Those skilled in the art to which the invention pertains may make modifications and other embodiments employing the principles of this invention without departing from its spirit or essential characteristics, particularly upon considering the foregoing teachings. The described embodiments are to be considered in all respects only as illustrative and not restrictive and the scope of the invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of invention.

What is claimed is:

1. A baby carrier adapted to support and carry a baby therein, comprising:

a carrier body including a front cover portion, a crotch cover portion, and a back cover portion, which are all integral with one another;

a pair of shoulder belts respectively including first belt members connected to and extending from said back cover portion;

first buckles respectively connected at free ends of said first belt members extending away from said back cover portion;

second belt members respectively connected to and extending from said front cover portion;

second buckles that are respectively connected at free ends of said second belt members extending away from said front cover portion, and that are respectively detachably engageable with said first buckles;

at least one pair of ring members connected to said back cover portion; and hook members that are connected to said front cover portion and that are respectively detachably engageable with said ring members.

2. The baby carrier according to claim 1, wherein said shoulder belts including said first belt members respectively extend from free corner portions of said back cover portion located away from said crotch cover portion, said second belt members respectively extend from free corner portions of said front cover portion located away from said crotch cover portion, and said hook members respectively extend from said free corner portions of said front cover portion.

3. The baby carrier according to claim 1, wherein said second belt members are respectively connected to said first belt members on said carrier body.

4. The baby carrier according to claim 1, comprising a plurality of pairs of said ring members that are each respectively adapted to be selectively detachably engageable with said hook members.

5. The baby carrier according to claim 4, wherein a first one of said pairs of said ring members is connected to said back cover portion relatively closer to said crotch cover portion, and a second one of said pairs of said ring members is connected to said back cover portion relatively farther from said crotch cover portion.

6. The baby carrier according to claim 1, further comprising a headrest that is connected to and extends from said back cover portion and that is adapted to support the back of the head of a baby being carried in said baby carrier, and a head support including a head support body and band-like portions extending laterally from said head support body in two opposite lateral directions, wherein at least a portion of said head support body overlaps a portion of said headrest and only a fixed edge portion of said head support body is attached to said headrest so that said head support body is selectively tiltable relative to said headrest about said fixed edge portion, and comprising fasteners provided on free ends of said band-like portions extending away from said head support body and fastenable to said back cover portion or said shoulder belts.

7. The baby carrier according to claim 6, wherein said head support body is selectively tiltable relative to said headrest in such a manner so that said head support body protrudes at an angle away from a portion of said headrest overlapped by said head support body and is thereby positioned and adapted to protect the top of the head of a baby being carried in said baby carrier in a horizontal lying orientation, and so that said head support body extends substantially parallel and flush with said headrest and is thereby positioned and adapted to support the back of the head of a baby being carried in said baby carrier in a vertical upright orientation.

8. The baby carrier according to claim 6, wherein said second belt members are respectively connected to said first belt members on said carrier body.

9. The baby carrier according to claim 6, wherein said fixed edge portion of said head support body is secured to said headrest along a line extending parallel to and displaced between upper and lower edges of said headrest, and said fixed edge portion forms a hinge joint along said line.

10. The baby carrier according to claim 9, wherein said headrest includes an outer headrest cover and a headrest core arranged in said outer headrest cover, said head support body includes an outer head support cover and a head support core arranged in said outer head support cover, and at least a portion of said head support core overlaps a portion of said headrest core.

11. The baby carrier according to claim 6, further comprising a belt piece having two opposite ends, of which one end is connected to said head support body and one end is connected to said headrest, and wherein a middle portion of said belt piece between said two opposite ends is not connected directly to said head support body or said headrest.

12. The baby carrier according to claim 1, further comprising a head support connected to and extending from said back cover portion and adapted to support the head of a baby being carried in said baby carrier, wherein said head support includes a head support cover and first and second core members arranged in said head support cover, and further comprising a belt piece that has two opposite ends respectively connected to said head support and a middle portion between said two opposite ends that is not connected directly to said head support and extends along an area of said head support in which said first core member is arranged and an area of said head support in which said second core member is arranged.

13. The baby carrier according to claim 12, wherein said first and second core members at least partially overlap each other.

14. The baby carrier according to claim 12, wherein said head support includes a head support body that is connected to and extends from said back cover portion and that has said core members therein, band-like portions extending laterally from said head support body in two opposite lateral directions, and fasteners provided on free ends of said band-like portions extending away from said head support body and adapted to be fastened to said back cover or said shoulder belts.

15. A baby carrier adapted to support and carry a baby therein and to be worn and carried by a person, comprising:

a carrier body including a front cover portion, a crotch cover portion, and a back cover portion, which are all integral with one another;

shoulder belts connected to and extending from said carrier body;

a head support that is connected to and extends from said back cover portion, wherein said head support has a headsupporting surface adapted to face and support the head of a baby being carried in said baby carrier and an outwardly facing surface opposite said head-supporting surface, and wherein said head support includes a head support cover and first and second core members arranged in said head support cover in such a manner that said first and second core members partially overlap each other; and a belt piece having two opposite ends attached to said head support so that said belt piece extends along said outwardly facing surface of said head support and is adapted to receive, between said belt piece and said outwardly facing surface, a hand of the person wearing said baby carrier.

16. The baby carrier according to claim 15, wherein said head support comprises a headrest that is connected to and extends from said back cover portion and that is adapted to support the back of the head of the baby being carried in said baby carrier, a head support body that is arranged partially overlapping said headrest and that is connected to said headrest only along a fixed edge portion of said head support body, band-like portions extending laterally from said head support body in two opposite lateral directions, and fasteners provided on free ends of said band-like portions and adapted to be fastened to said back cover portion or said shoulder belts.

* * * * *

UNITED STATES PATENT AND TRADEMARK OFFICE
CERTIFICATE OF CORRECTION

PATENT NO. : 6,045,018

DATED : Apr. 4, 2000

INVENTOR(S) : Onishi

It is certified that error appears in the above-identified patent and that said Letters Patent is hereby corrected as shown below:

Col. 7, line 49, after "fastener)", replace "replace and" by --or--;

Col. 9, line 34, after "bundled", replace ", together" by --together,--;

Col.10, line 24, after "provided" , insert --on--;

Signed and Sealed this

Sixth Day of February, 2001

*Attest:*

*Attesting Officer*

Q. TODD DICKINSON

*Director of Patents and Trademarks*